US011796214B2

(12) United States Patent
Schmidt et al.

(10) Patent No.: US 11,796,214 B2
(45) Date of Patent: Oct. 24, 2023

(54) APPARATUS FOR TENSIONING PLIABLE AIRDUCTS WHILE SUPPORTING INTERNAL HVAC COMPONENTS

(71) Applicant: Rite-Hite Holding Corporation, Milwaukee, WI (US)

(72) Inventors: Blaine Schmidt, Peosta, IA (US); Kevin J. Gebke, Dubuque, IA (US); Nicholas L. Kaufmann, Sherrill, IA (US); William A. Niehaus, Holy Cross, IA (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 57 days.

(21) Appl. No.: 17/319,766

(22) Filed: May 13, 2021

(65) Prior Publication Data

US 2021/0356162 A1 Nov. 18, 2021

Related U.S. Application Data

(60) Provisional application No. 63/024,061, filed on May 13, 2020.

(51) Int. Cl.
*F24F 13/02* (2006.01)
*F24F 11/70* (2018.01)
(Continued)

(52) U.S. Cl.
CPC ..... *F24F 13/0218* (2013.01); *F15D 1/0005* (2013.01); *F24F 1/0373* (2019.02); *F24F 11/70* (2018.01)

(58) Field of Classification Search
CPC ..... F24F 13/0218; F24F 11/70; F24F 1/0373; F15D 1/0005
(Continued)

(56) References Cited

U.S. PATENT DOCUMENTS 9,612,033 B2 4/2017 Pinkalla et al.
9,784,469 B2 * 10/2017 Ramos ..... F24F 13/0263
(Continued)

FOREIGN PATENT DOCUMENTS

JP S60223945 11/1985
KR 101490223 2/2015
(Continued)

OTHER PUBLICATIONS

Intellectual Property India, "Examination report under sections 12 & 13 of the Patents Act, 1970 and the Patents Rules, 2003," dated Jan. 10, 2023, 8 pages.
(Continued)

*Primary Examiner* — Craig M Schneider
*Assistant Examiner* — David R Deal
(74) *Attorney, Agent, or Firm* — Hanley, Flight & Zimmerman, LLC

(57) ABSTRACT

Apparatus for tensioning pliable airducts while supporting internal HVAC components are disclosed. An airduct system includes an airduct having an elongate tubular wall of a pliable material. The airduct system further includes a frame disposable inside the tubular wall of the airduct, the frame including a hoop to support the tubular wall in a radial direction, the hoop to define an opening to provide passage of a flow of air along a length of the airduct. The airduct system also includes an HVAC component disposable within the tubular wall of the airduct, the HVAC component to be attached to and supported by the frame inside the airduct, the HVAC component to adjust a characteristic of the air.

29 Claims, 18 Drawing Sheets

(51) Int. Cl.
*F15D 1/00* (2006.01)
*F24F 1/0373* (2019.01)

(58) Field of Classification Search
USPC ..... 138/37
See application file for complete search history.

(56) References Cited

U.S. PATENT DOCUMENTS

| | | | | |
|---|---|---|---|---|
| 2003/0022617 | A1 | 1/2003 | Gebke et al. | |
| 2009/0152096 | A1 | 6/2009 | Carlson | |
| 2012/0028562 | A1 | 2/2012 | Heim et al. | |
| 2012/0125472 | A1 | 5/2012 | Pinkalla et al. | |
| 2014/0254090 | A1* | 9/2014 | Gardner | F24F 11/74 165/96 |
| 2016/0341443 | A1* | 11/2016 | Ramos | F24F 13/0281 |
| 2017/0205109 | A1* | 7/2017 | Pinkalla | F24F 13/0254 |

FOREIGN PATENT DOCUMENTS

| | | |
|---|---|---|
| WO | 2012173580 A2 | 12/2012 |
| WO | 2016187291 | 11/2016 |

OTHER PUBLICATIONS

International Searching Authority, "International Preliminary Report on Patentability," issued in connection with International Application No. PCT/US2021/032267, dated Nov. 24, 2022, 11 pages.
European Patent Office, "Communication Pursuant to Rules 161(1) and 162 EPC," issued in connection with European Application No. 21730391.6, dated Dec. 22, 2022, 3 pages.
International Searching Authority, "Invitation to Pay Additional Fees," issued in connection with International Application No. PCT/US2021/032267, dated Aug. 6, 2021, 10 pages.
International Searching Authority, "International Search Report and Written Opinion," issued in connection with International Application No. PCT/US2021/032267, dated Sep. 27, 2021, 15 pages.

* cited by examiner

APPARATUS FOR TENSIONING PLIABLE AIRDUCTS WHILE SUPPORTING INTERNAL HVAC COMPONENTS

RELATED APPLICATION(S)

This patent arises from a non-provisional patent application that claims the benefit of U.S. Provisional Patent Application No. 63/024,061, which was filed on May 13, 2020. U.S. Provisional Patent Application No. 63/024,061 is hereby incorporated herein by reference in its entirety. Priority to U.S. Provisional Patent Application No. 63/024,061 is hereby claimed.

FIELD OF THE DISCLOSURE

This patent generally pertains to pliable wall airducts and more specifically to apparatus for tensioning pliable airducts while supporting internal HVAC (heating, ventilating, and air conditioning) components.

BACKGROUND

Ductwork is often used for conveying conditioned air (e.g., heated, cooled, filtered, etc.) discharged from a fan and distributing the air to a room or other areas within a building. Ducts are typically formed of rigid metal, such as steel, aluminum, or stainless steel. In many installations, ducts are hidden above suspended ceilings for convenience and aesthetics. But in warehouses, manufacturing plants and many other buildings, the ducts are suspended from the roof of the building and are thus exposed.

Figure 1:
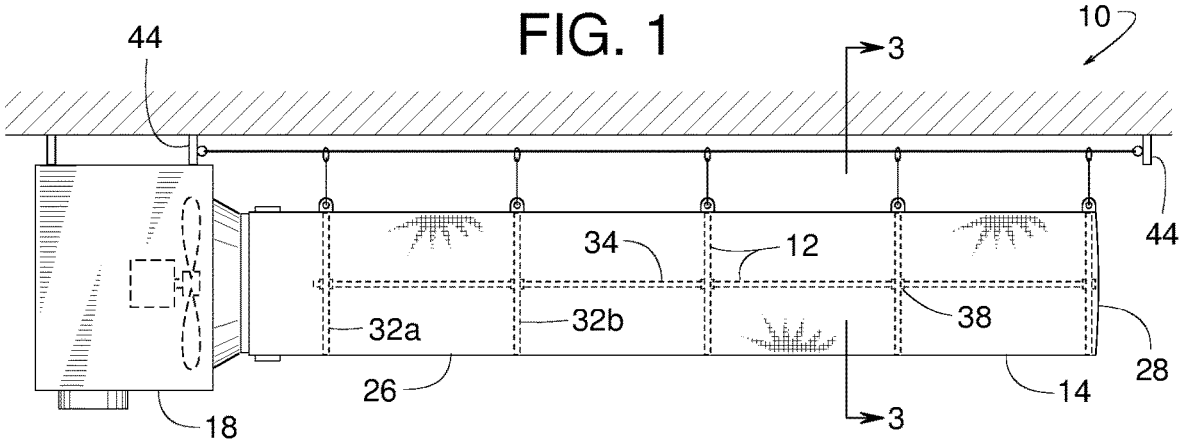
FIG. 1 is a side view of an example airduct system constructed in accordance with teachings disclosed herein, showing an example blower of the airduct system de-energized.

Unless specifically stated otherwise, descriptors such as "first," "second," "third," etc. are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name. As used herein, "approximately", "substantially," and "about" refer to dimensions that may not be exact due to manufacturing tolerances and/or other real world imperfections.

DETAILED DESCRIPTION

In those warehouse or manufacturing environments where prevention of air-borne contamination of the inventory is critical, metal ducts can create problems.

For instance, temperature variations in the building or temperature differentials between the ducts and the air being conveyed can create condensation on both the interior and exterior of the ducts. The presence of condensed moisture on the interior of the duct may facilitate the growth of mold or bacteria that then is conveyed by the duct into the room or other areas being supplied with the conditioned air. In the case of a space ventilated by exposed ducts, condensation on the exterior of the duct can drip onto the inventory or personnel below. The dripping can create hazardous working conditions, damage/contaminate equipment, or product underneath the duct (particularly in food-processing facilities), etc.

Further, metal ducts with localized discharge registers can create uncomfortable drafts and unbalanced localized heating or cooling within a building. In many food-processing facilities where the target temperature is around 42 degrees Fahrenheit, a cold air draft can be especially uncomfortable and potentially unhealthy.

Many of the above problems associated with metal ducts are overcome by the use of flexible fabric ducts. Such ducts typically have a pliable fabric wall (often porous) that inflates to a generally cylindrical shape by the pressure of the air being conveyed by the duct. Condensation does not tend to form on the exterior walls of fabric ducts to the extent it does on metal ducts in the same environment, in part due to the fabric having a lower thermal conductivity than that of metal ducts. In addition, the inherent porosity of the fabric used and/or additional ventilation holes distributed along the length of the fabric duct enable relatively broad and even dispersion of air into the room being conditioned or ventilated. The even distribution of airflow along the length of the duct, as opposed to only at local registers, also effectively ventilates the walls of the fabric duct itself, thereby further inhibiting the growth of mold and bacteria.

In examples of fabric airducts disclosed herein, pliable tubular walls of example airducts are held in an expanded shape by a relatively rigid internal frame. In some examples, the airducts can also support various internal HVAC components (also referred to herein as HVAC fixtures), such as guide vanes, fixed dampers, adjustable valves, valve controllers, sensors, air filters, fans, and heat exchangers. More particularly, in some examples, such HVAC components are placed internally within a length of a pliable airduct (e.g., so that the tubular wall of the pliable airduct radially surrounds the components). In some examples, such HVC components are held in place within the airduct by being attached to and/or supported by the internal frame. In some examples, an HVAC component disposed within a pliable airduct is spaced apart from both ends (e.g., upstream and downstream ends) of the airduct such that the tubular walls of the airduct extend away from the HVAC component in both direction. In some examples, the pliable airduct corresponding to either a supply side length of airduct or a return side length of airduct is formed of at least two separate airduct sections corresponding to separate elongate tubes. In some such examples, an HVAC component is positioned at or between the adjacent ends (e.g., intermediate ends) of the two separate airduct sections. In some such examples, the HVAC component is still radially within the pliable airduct by the separate ends of the two separate sections being connected radially around the HVAC component. In other examples, the adjacent ends of the two separate airduct sections are spaced apart and separated by the HVAC component positioned therebetween. To heat or cool the air flowing through the airduct, some example frames include a hollow shaft that conveys hot or cold fluid, or carries electric resistance wires. In some examples, a variable air volume (VAV) controller, which adjusts a valve to vary the volume of airflow through the airduct, is mounted to the frame at a T section or cross-section of the airduct.

FIGS. 1-39 show various example airduct systems including a relatively rigid internal frame that supports an airduct having a tubular wall made of a pliable material; the frame also supports various internal HVAC components, such as guide vanes, fixed dampers, adjustable valves, valve controllers, sensors, air filters, fans, and temperature altering devices. FIGS. 1-6 show some basic construction elements of example airduct systems 10 (e.g., airduct systems 10*a-f*).

Figure 2:
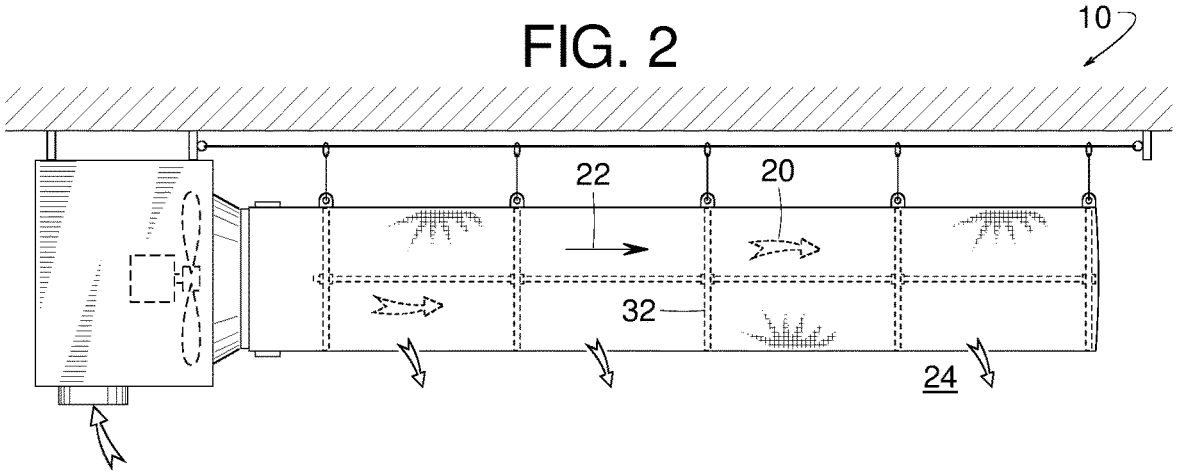
FIG. 2 is a side view similar to FIG. 1 but showing the example airduct system when the blower is energized.
Figure 3:
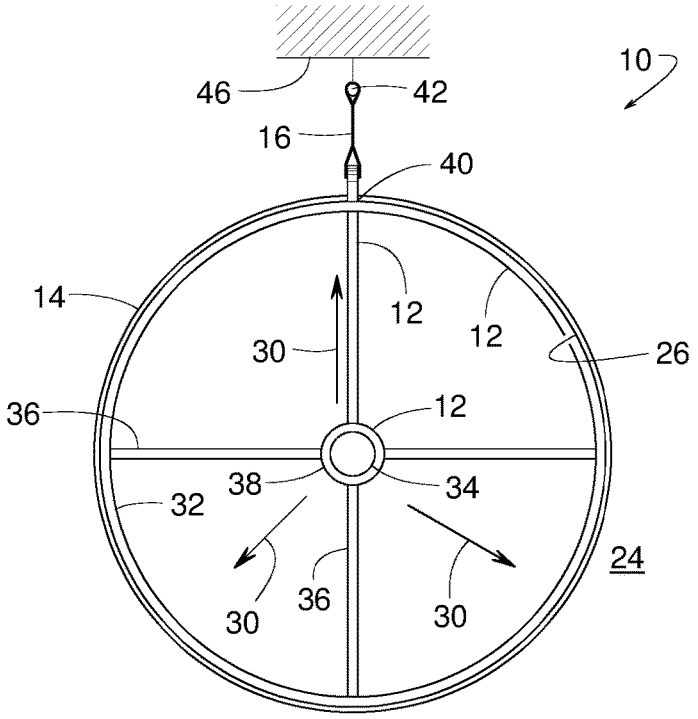
FIG. 3 is a cross-sectional view taken along line 3-3 of FIG. 1.

In the example shown in FIGS. 1-3, airduct system 10 includes a frame 12, a pliable fabric airduct 14, at least one hanger 16, and a blower 18 (e.g., centrifugal fan, axial fan, etc.). To ventilate or otherwise condition a space 24 within a building, the blower 18 forces a current of air (airflow) 20 in a generally longitudinal direction 22 through the airduct 14, which ultimately disperses the air into the targeted space 24. The term, "longitudinal direction," as it relates to an airduct, refers to the lengthwise or axial dimension of the duct. The longitudinal direction is the general path along which most of the air flows through the duct. For airducts that are straight (e.g., the example airduct of FIGS. 1 and 2), the longitudinal direction is linear, even if the air might actually flow in a helical or turbulent pattern through the length of the duct. For airducts with one or more elbows or curves (e.g., the example airduct of FIG. 4), the longitudinal direction curves likewise. Airducts with one or more T-sections (e.g., the example airduct of FIG. 5), cross-sections (e.g., the example airduct of FIG. 6) or other types of manifolds for creating a plurality of branch ducts have multiple longitudinal directions (e.g., a longitudinal direction for each branch).

The airduct 14 includes a tubular wall 26 made of a pliable material. The term, "pliable material" refers to a sheet of material that can be readily folded over onto itself, unfolded and restored to its original shape without appreciable damage to the material. Fabric is one example of a pliable material, and sheet metal is an example of a material that is not pliable. Specific example materials of the tubular wall 26 include vinyl, polyester sheeting, and polyester fabric. Some example materials used for the airduct 14 may result in a tubular wall 26 that is perforated, porous, impervious to gas, or combinations thereof (e.g., some porous areas and some areas impervious to gas). Some example materials are impregnated or coated with a sealant, such as acrylic or polyurethane. Some example materials are uncoated. Some example materials are fire or heat resistant. To release the air from within the airduct 14 to the building space the airduct serves, the tubular wall 26 and/or an end cap 28 of the airduct 14 includes one or more discharge openings such as, for example, cut-out openings, plastic or metal discharge registers or nozzles, and/or porosity in the tubular wall or in the end cap material itself.

To provide the tubular wall 26 with support in a radial direction 30 (perpendicular to the longitudinal direction 22), the frame 12 is relatively rigid and less flexible than the tubular wall 26. In some examples, the frame 12 also holds the tubular wall 26 taut with respect to the longitudinal direction 22. Example materials of the frame 12 include metal, fiberglass, relatively rigid plastic, and combinations thereof.

In the illustrated examples, the frame 12 includes a plurality of hoops 32 (e.g., a first hoop 32*a* and a second hoop 32*b*) and a shaft 34 extending between and coupling the hoops 32 together and maintaining the position of each hoop 32 relative to another hoop 32. The example shaft 34 may be a rod, a bar, a tube, and/or a pipe. In some examples, the shaft 34 is solid. In some examples, the shaft 34 is tubular. The hoops 32 are fixed to the shaft 34 at longitudinally spaced-apart positions within the airduct 14. In some examples, one or more spokes 36 extending between the hoop 32 and a hub 38 hold the shaft 34 in a radially centered position, as shown in FIGS. 1-3. In some examples, one or more shafts 34 are positioned against or adjacent the inner surface of the tubular wall 26 and extend in the longitudinal direction 22 directly connected to hoops 32. In such examples, the spokes 36 and the hub 38 may be omitted.

The example hanger 16 of FIGS. 1-3 is schematically illustrated to represent any means for supporting the airduct 14 in suspension from a structural support 46. In some examples, the hanger 16 is a cable, rod, or strap extending vertically between an anchor point 40 on the airduct 14 and an overhead rod, bar, beam, or cable 42. Example mounting locations of the anchor point 40 include the hoop 32, the spoke 36, the shaft 34, and/or the tubular wall 26. In some examples, brackets 44 couple the cable 42 to the structural support 46 (e.g., a ceiling, truss or beam).

Figure 4:
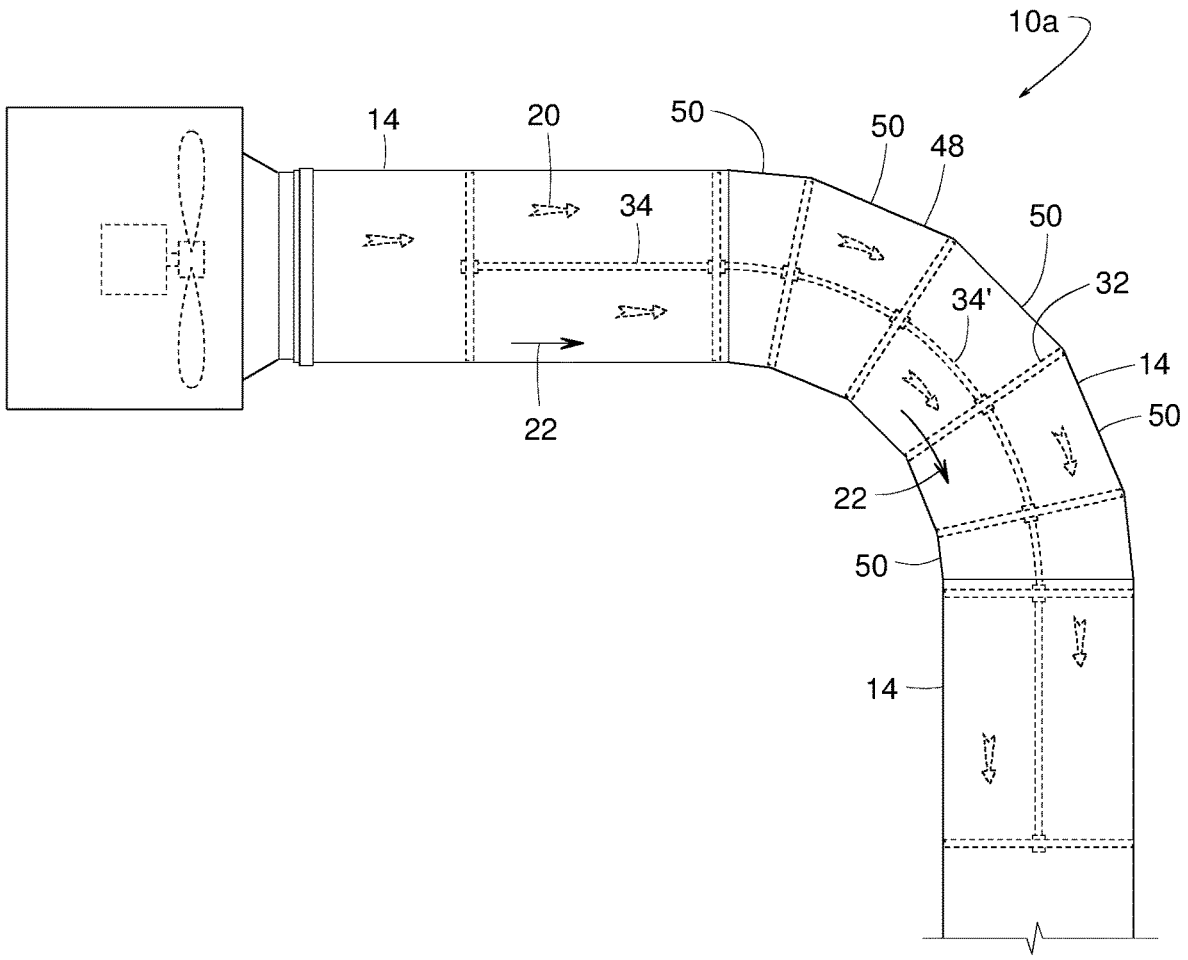
FIG. 4 is a top view of an example airduct system constructed in accordance with teachings disclosed herein, the airduct system including an elbow.

In the illustrated example of FIG. 4 (top view), an example airduct system 10*a* includes an elbow 48 to redirect the airflow 20 along a curve or angled turn. The elbow 48 portion of the airduct 14 includes a series of tubular sections 50 that are sewn or otherwise joined to create the desired airflow path shape. In some examples, the tubular sections 50 include the same pliable material as other tubular wall portions of the airduct 14. As with the straight portions of the airduct 14, hoops 32 are positioned along the longitudinal dimension of the elbow to provide the tubular wall 26 of the airduct 14 with support. In some examples, a curved or articulated version of the shaft 34 (e.g., a shaft section 34') follows the general curvature of the elbow 48 coupling the hoops 32 together and maintaining the position of each hoop 32 relative to another hoop 32.

Figure 5:
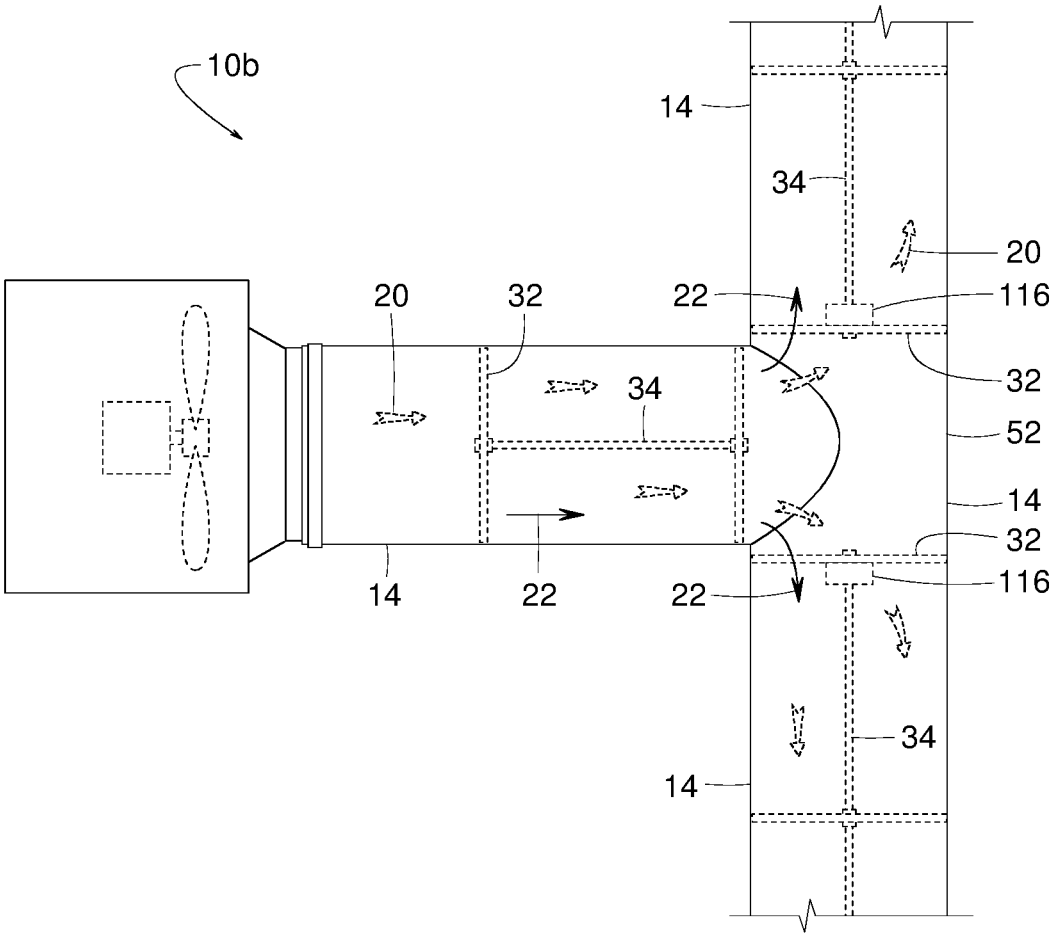
FIG. 5 is a top view of an example airduct system constructed in accordance with teachings disclosed herein, the airduct system including a T-section.

In the illustrated example of FIG. 5 (top view), an example airduct system 10*b* includes a T-section 52 to split the airflow 20 from the airduct connected to the blower into two branch airducts positioned at right angles therefrom. In alternate examples, the T-section 52 may redirect the current of air 20 at any other angle or include more than two branch airducts 14. In some examples, the T-section 52 of the airduct 14 includes the same pliable material as other tubular wall portions of the airduct 14. The hoops 32 are positioned along the longitudinal dimension of the airduct 14 to provide the airduct 14 with support.

Figure 6:
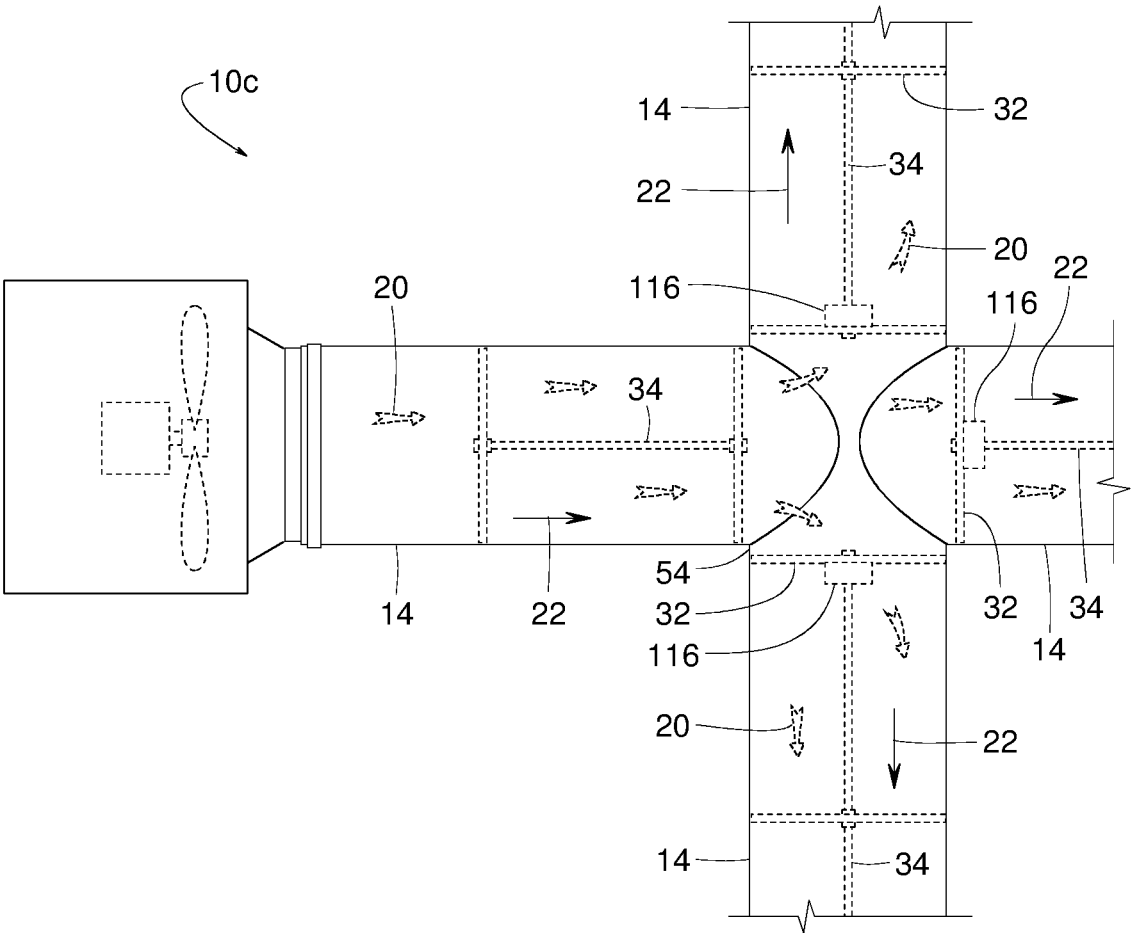
FIG. 6 is a top view of an example airduct system constructed in accordance with teachings disclosed herein, the airduct system including a cross-section.

In the illustrated example of FIG. 6 (top view), an example airduct system 10*c* includes a cross-section 54 (also known as a manifold) to split the airflow 20 from the blower into three paths. In some examples, the cross-section 54 of the airduct 14 includes the same pliable material as other tubular wall portions of the airduct 14. Hoops 32 are positioned along the longitudinal dimension of the airduct 14 to provide the airduct 14 with support.

Figure 7:
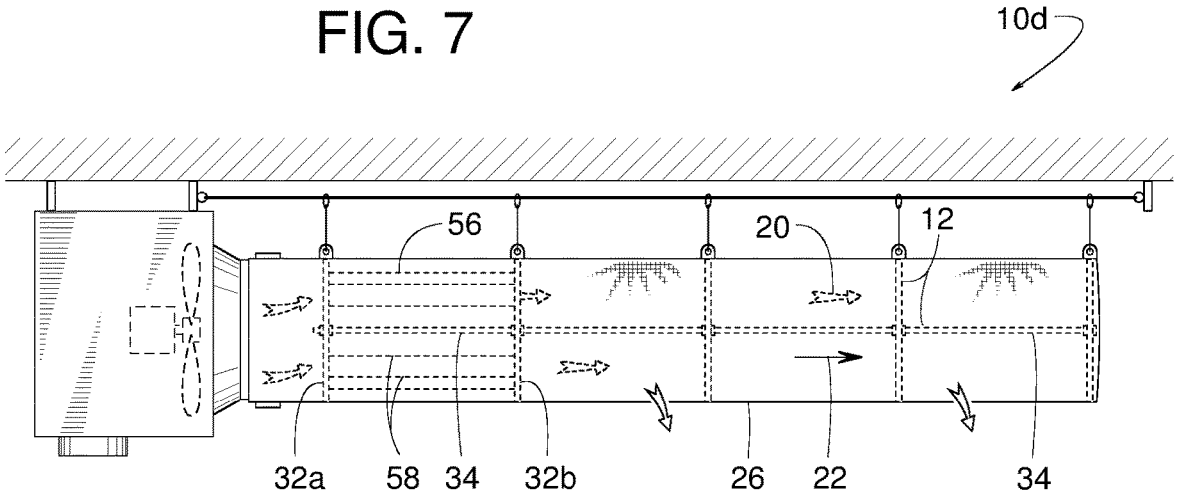
FIG. 7 is a side view similar to FIG. 2 and showing another example airduct system constructed in accordance with teachings disclosed herein, the airduct system including an example air straightener.
Figure 8:
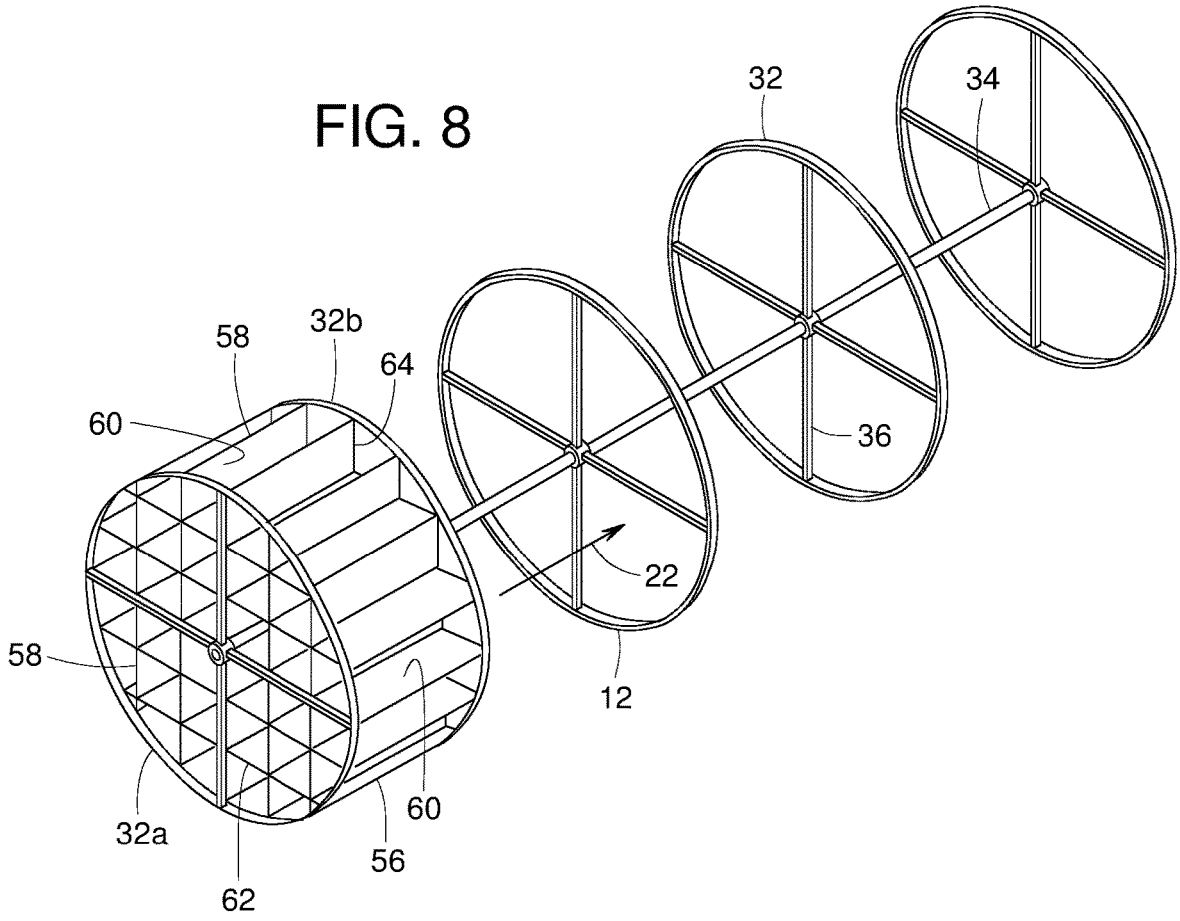
FIG. 8 is a perspective view of the example frame and the example air straightener shown in FIG. 7.

In the illustrated example of FIGS. 7 and 8, an example airduct system 10*d* includes an air straightener 56 (also referred to herein as a turbulence straightener). The air straightener 56 directs the airflow 20 in a generally linear path reducing (e.g., minimizing) turbulence and other undesirable flow patterns. The air straightener 56 has one or more airflow guide vanes 58, each having a generally planar guiding surface 60 extending from an upstream leading edge 62 to a downstream trailing edge 64. The guiding surface 60 lies substantially parallel (e.g., parallel within plus or minus ten degrees) to the longitudinal direction 22 and directs the airflow 20 in a parallel direction.

In some examples, the guide vanes 58 are less flexible than the pliable material of the tubular wall 26. A relatively rigid material ensures that the guide vanes 58 are sufficiently stiff to straighten the airflow 20 rather than yielding to it. In some examples, the guide vanes 58 include sheet metal and/or rigid plastic. To support a relatively stiff structure within a pliable wall airduct, the air straightener 56 is attached to and supported by the frame 12. In the illustrated example of FIGS. 7 and 8, the air straightener 56 extends between two hoops 32*a* and 32*b* of the frame 12. In other examples, the air straightener 56 may extend farther than the distance between the two adjacent hoops 32.

Figure 9:
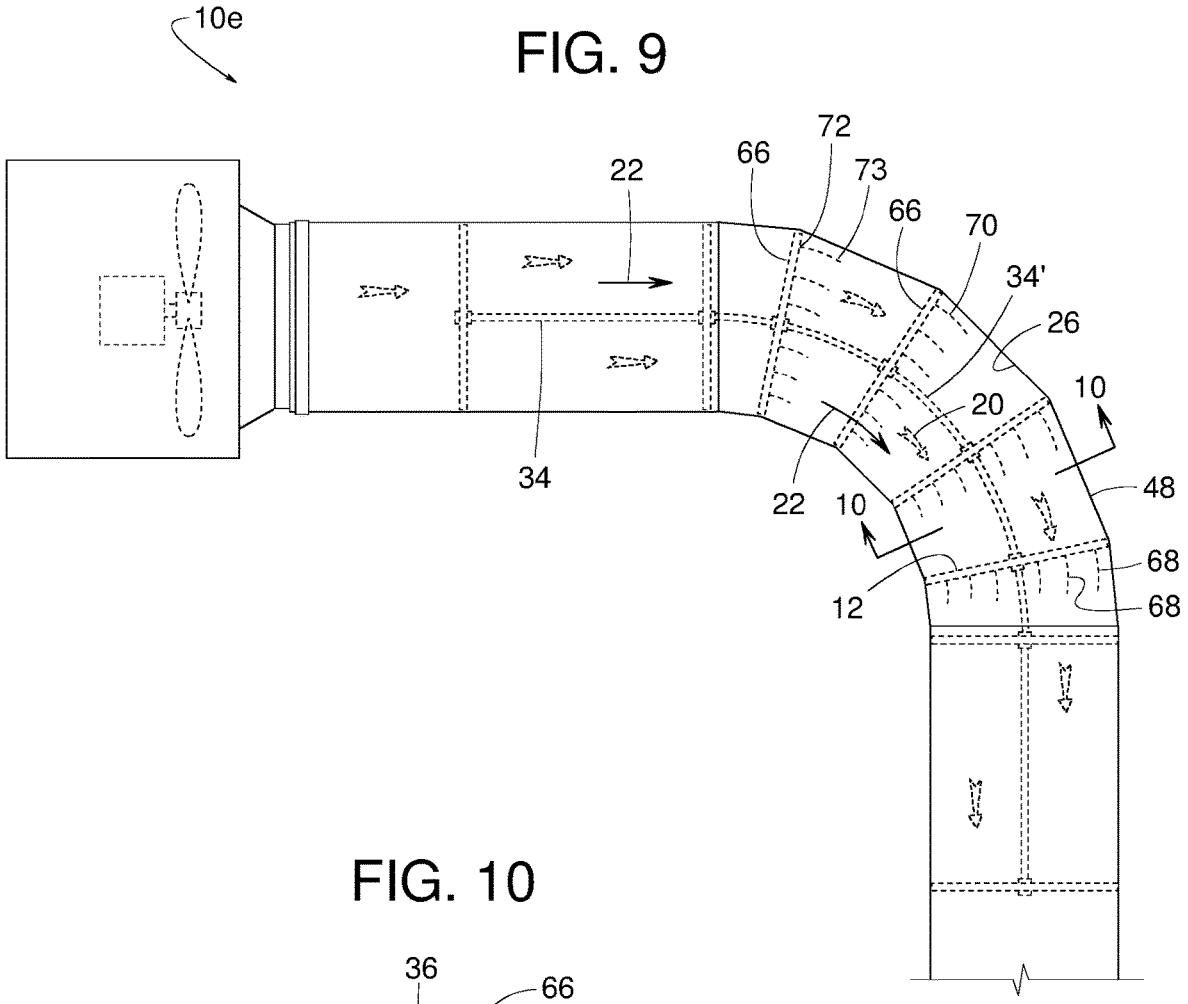
FIG. 9 is a top view similar to FIG. 4 but with the airduct system including an example flow turning device constructed in accordance with teachings disclosed herein.
Figure 10:
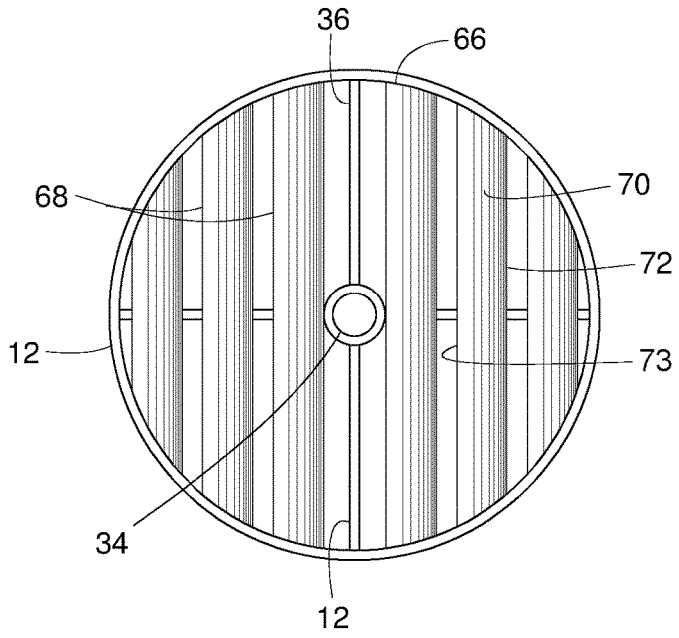
FIG. 10 is a cross-sectional view taken along line 10-10 of FIG. 9.

FIGS. 9 and 10 illustrate an example airduct system 10*e* with an example flow turning device 66 for directing the airflow 20 through the elbow 48. In this example, the flow turning device 66 includes one or more guide vanes 68, each having a curved guiding surface 70 lying substantially parallel to the longitudinal direction 22 and extending from an upstream leading edge 72 to a downstream trailing edge 73. The guiding surface 70 guides the airflow 20 along a curved longitudinal direction 22 that extends through the elbow 48. As shown in the illustrated examples of FIGS. 38 and 39, the flow turning device 66 can be incorporated into elbows 134, 136, which are more compact than the elbow 48. These example elbows 134, 136 provide a zero or near zero radius turn (as measured at the wall 26 of the airduct 14) in comparison to a much larger radius turn of the example elbow of FIG. 9. Accordingly, the elbow 134, 136 enables a change in longitudinal direction 22 of the airduct 14 over a shorter length of the airduct 14 and can be constructed of fewer tubular sections 50.

In some examples, the guide vanes 68 are less flexible than the pliable material of the tubular wall 26 of the elbow 48. A relatively rigid material ensures that the guide vanes 68 are sufficiently stiff to guide the airflow 20 rather than yielding to it. In some examples, the guide vanes 68 include sheet metal and/or rigid plastic. To support a relatively stiff structure within a pliable wall airduct, the turning device 66 is attached to and supported by the frame 12. In this example, the frame 12 includes a curved or articulated shaft section 34' that aligns with the curved portion of the longitudinal direction 22.

Figure 11:
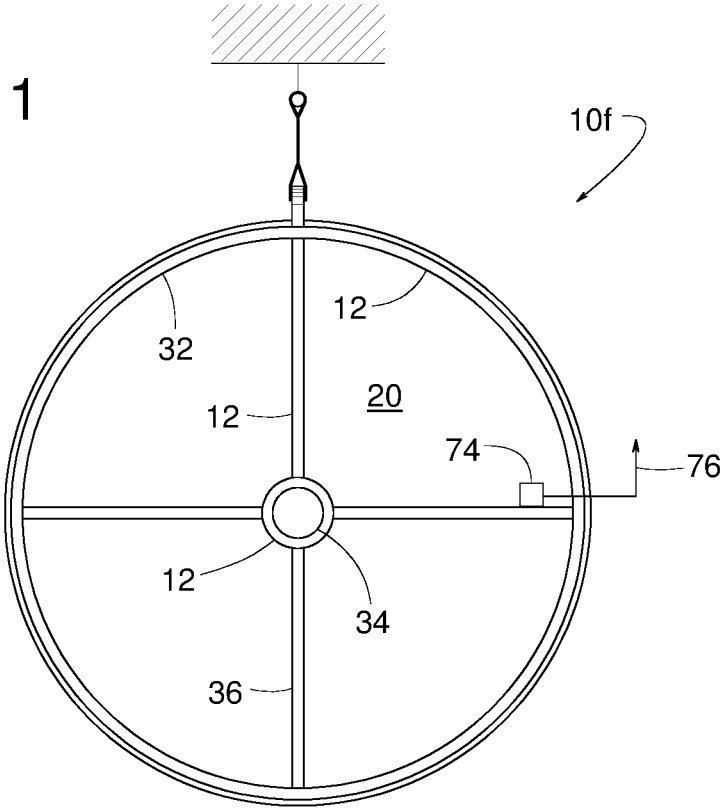
FIG. 11 is a cross-sectional view similar to FIG. 3 but showing the airduct system having an example frame-mounted sensor that provides an electric feedback signal.
Figure 12:
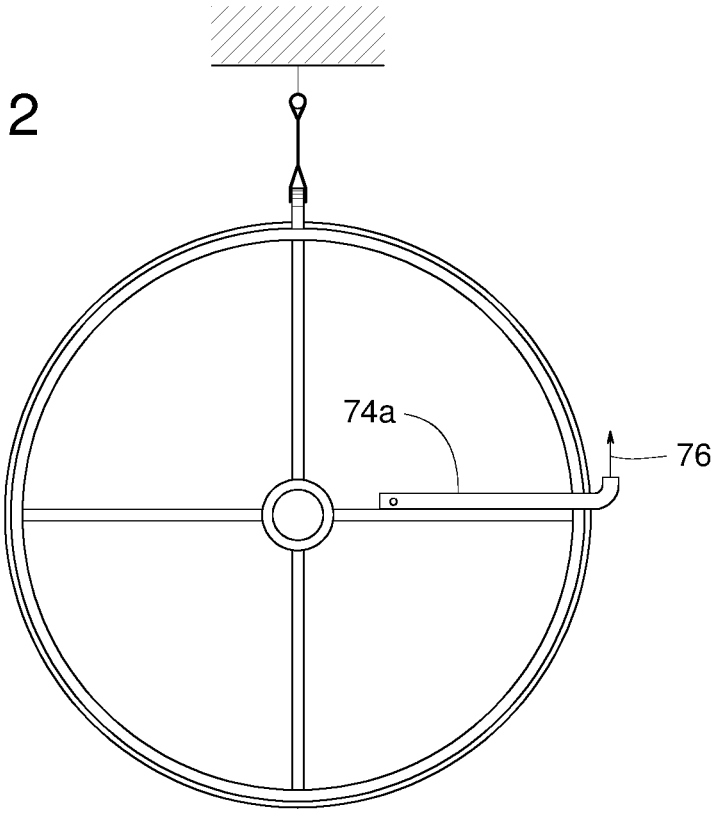
FIG. 12 is a cross-sectional view similar to FIG. 3 but showing the airduct system having an example frame-mounted sensor that provides a pneumatic feedback signal.

FIG. 11 illustrates an example airduct system 10*f* that includes one or more sensor(s) 74 attached to the frame 12. The frame 12 provides the sensor(s) 74 with more secure support than other more flexible portions of the airduct system 10*f*. Example mounting locations of the sensor 74 include the hoop 32, the spoke 36 and the shaft 34. The sensor 74 is positioned in fluid communication with the airflow 20 within the airduct 14 and provides a signal 76 that varies in response to a changing condition of the air 20. Examples of such a condition that may change and be detected by the sensor 74 include static air pressure, stagnation air pressure, airflow rate, air temperature, relative or total humidity, presence or concentration of smoke, presence or concentration of a toxic gas, concentration of carbon dioxide, concentration of oxygen, presence or concentration of particulate (e.g., dust), presence or concentration of contaminant (e.g., mold, bacteria, virus, etc.), etc.

The sensor 74 is schematically illustrated to represent any device that provides a signal in response to some changing condition of the air 20. Examples of the sensor 74 include a static pressure sensor, a stagnation pressure sensor, a pitot tube (pneumatic or electronic), an anemometer, a temperature sensor, a humidity sensor, a smoke detector, a fire detector, a toxic gas sensor, a carbon dioxide sensor, an oxygen sensor, a particulate sensor, etc. Example forms of the signal 76 include pneumatic and electric signals. In the example shown in FIG. 12, the sensor 74 is a stagnation pressure sensor 74*a*, where the signal 76 is pneumatic. The signal 76 can be used for monitoring or controlling the air 20.

FIGS. 13-19 are illustrated examples of the airduct system 10 that include a temperature altering device 78 (e.g., devices 78*a-f*) placed in heat transfer relationship with the air 20. In the illustrated examples, the temperature altering device 78 is attached to the frame 12, which provides more secure support than other more flexible portions of the airduct system 10. The terms "attached to" as it relates to a device being attached to a frame means that the device is fastened to the frame, coupled to the frame, borne by the frame, supported by the frame, or incorporated within the frame. Example attachment locations of the temperature altering device 78 include the hoop 32, the spoke 36 and the shaft 34.

Figure 13:
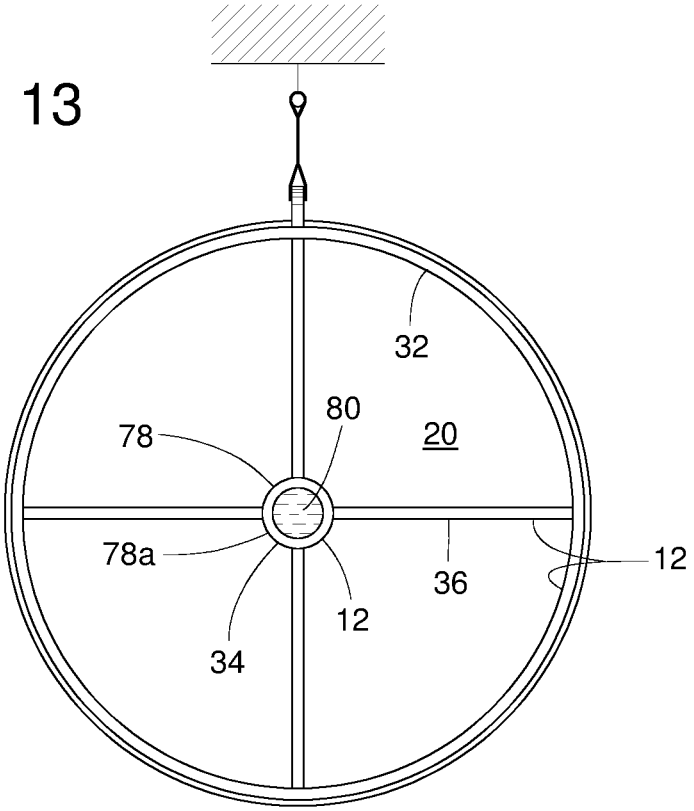
FIG. 13 is a cross-sectional view similar to FIG. 3 but showing an example tubular shaft conveying a fluid.

In the illustrated example of FIG. 13, the shaft 34 is hollow and serves as a conduit 78*a* for conveying a fluid 80 (e.g., water, glycol, refrigerant, carbon dioxide, brine, etc.) that heats or cools the air 20. In the illustrated example of FIG. 14, one or more separate conduits 78*b* extending in the longitudinal direction 22 are attached to the spoke 36, the shaft 34, and/or the hoop 32 and convey the fluid 80 for heating or cooling the air 20.

Figure 14:
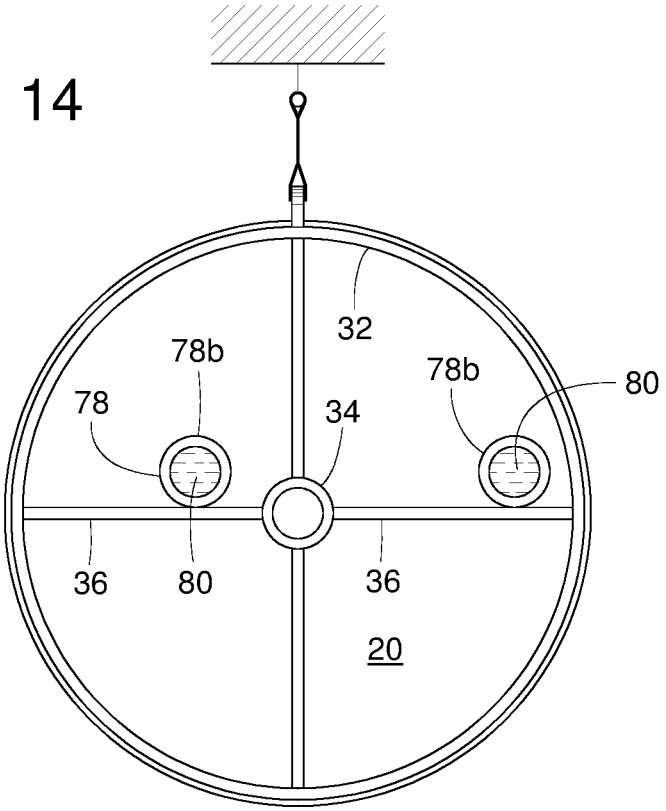
FIG. 14 is a cross-sectional view similar to FIG. 3 but showing the airduct system having an example frame-mounted tube conveying a fluid.
Figure 15:
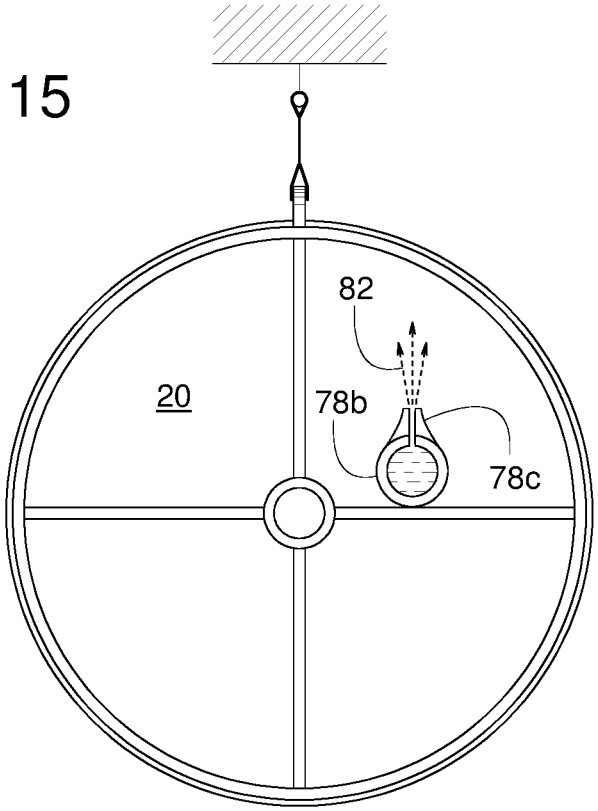
FIG. 15 is a cross-sectional view similar to FIG. 3 but showing the airduct system having an example nozzle for humidification.

The example shown in FIG. 15 is similar to that of FIG. 14 but with the addition of one or more spray nozzles 78*c* that release water from within the tube 78*b* to create a spray or mist of water 82 that humidifies the air 20. Depending on the humidity of the air and the temperature differential between the water 82 and the air 20, the one or more spray nozzles 78*c* change the humidity and/or the temperature of the current of air 20*d*.

Figure 16:
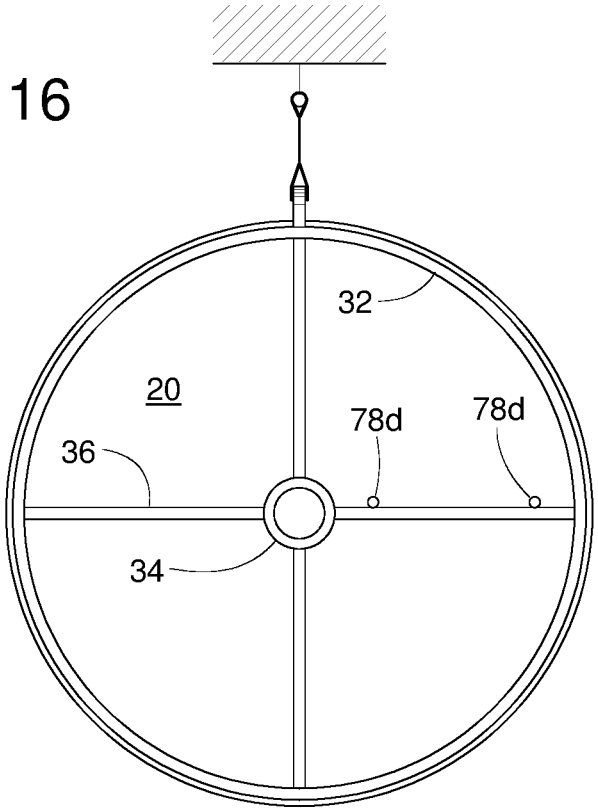
FIG. 16 is a cross-sectional view similar to FIG. 3 but showing the airduct system having an example frame-mounted electric resistance wire.
Figure 17:
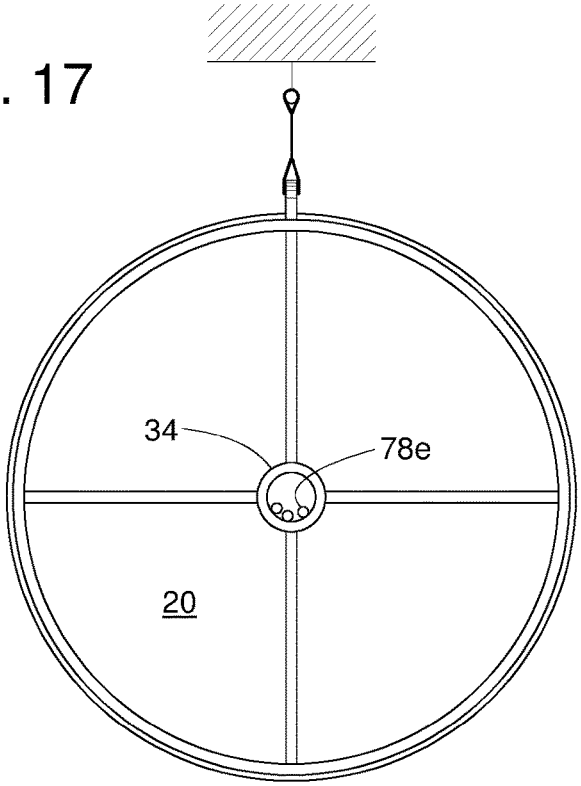
FIG. 17 is a cross-sectional view similar to FIG. 3 but showing a tubular shaft containing an example electric resistance wire.

In the illustrated example of FIG. 16, one or more electrical resistance wires 78*d* extending in the longitudinal direction 22 are attached to the spoke 36, the shaft 34, and/or the hoop 32 to heat the air 20. In the illustrated example of FIG. 17, the shaft 34 is hollow and serves as a conduit, containing one or more electrical resistance wires 78*e*. The wall material of the shaft 34 transfers heat radially from the one or more wires 78*e* to the air 20.

Figure 18:
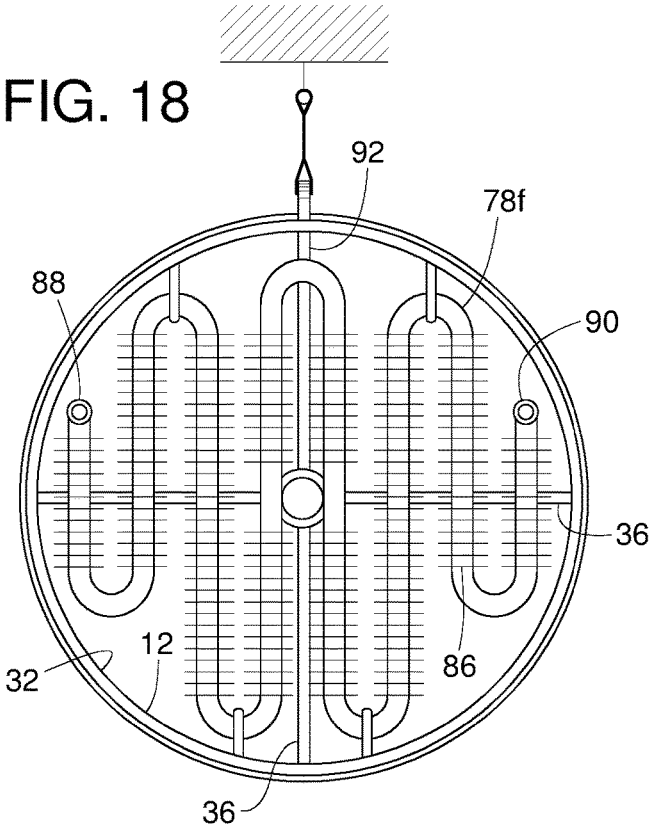
FIG. 18 is a cross-sectional view similar to FIG. 3 but showing the airduct system having an example frame-mounted heat exchanger.
Figure 19:
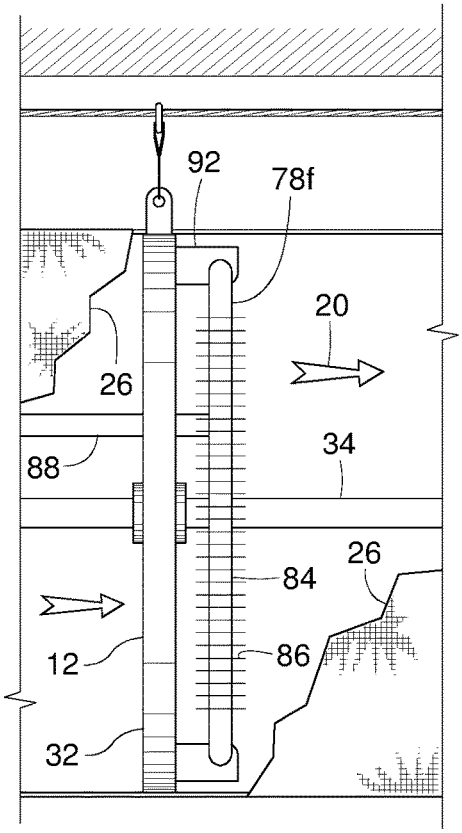
FIG. 19 is a cutaway side view of FIG. 18.

In the illustrated example of FIGS. 18 and 19, the airduct system 10 includes a heat exchanger 78*f* attached to the frame 12. In some examples, the heat exchanger 78*f* includes one or more heat transfer tubes 84 conveying fluid in heat transfer relationship with the air 20. In the illustrated example, the heat transfer tube 84 is in a serpentine arrangement. In other examples, the heat transfer tube 84 is in a coiled arrangement. In other examples, the heat exchanger 78*f* includes a plurality of heat transfer tubes 84 in a parallel arrangement between an inlet manifold and an outlet manifold. In some examples, the heat exchanger 78*f* includes a plurality of fins 86 that promote heat transfer as the fluid 80 circulates through the heat transfer tube 84. In the illustrated example of FIGS. 18 and 19, the fluid 80 enters the heat transfer tube 84 through an inlet tube 88 and exits through an outlet tube 90. In some examples, brackets 92 firmly connect the heat exchanger 78*f* to the hoop 32.

Figure 20:
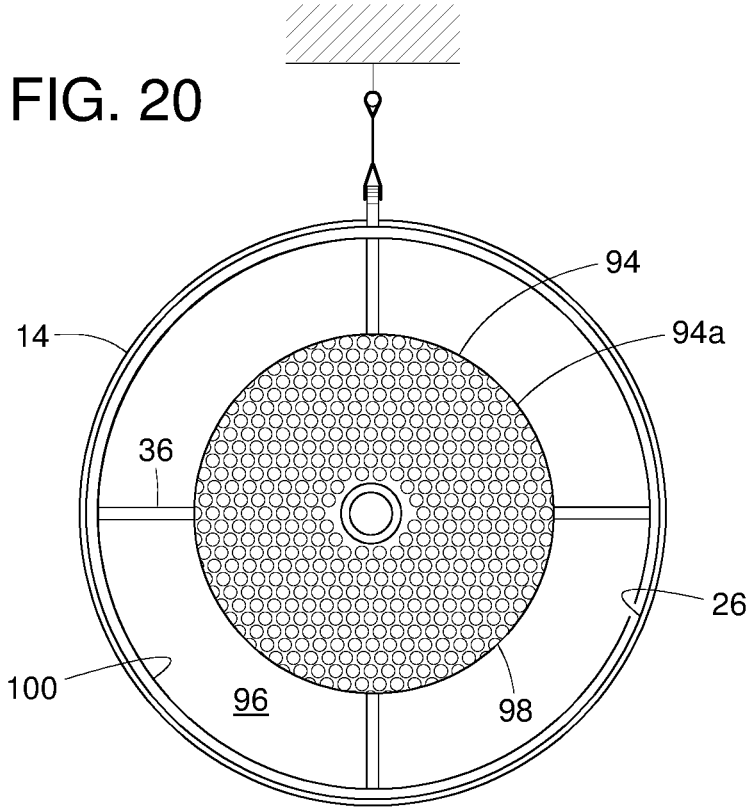
FIG. 20 is a cross-sectional view similar to FIG. 3 but showing the airduct system having an example baffle constructed in accordance with teachings disclosed herein.
Figure 21:
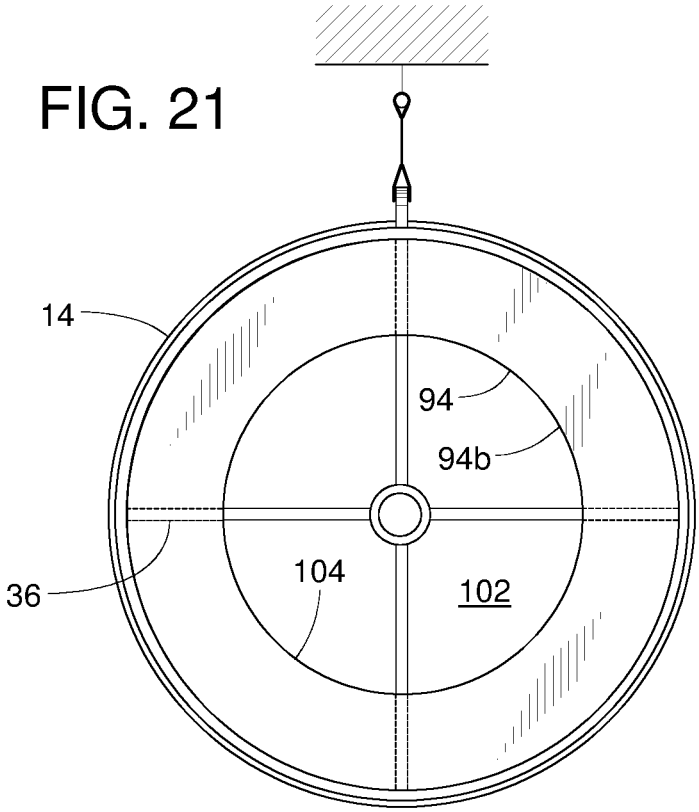
FIG. 21 is a cross-sectional view similar to FIG. 3 but showing the airduct system having another example baffle constructed in accordance with teachings disclosed herein.

As shown in FIGS. 20 and 21, in some examples the airduct system 10 includes a baffle 94 (e.g., baffle 94*a* or 94*b*) attached to the frame 12. To withstand a pressure differential created by the airflow 20 across the baffle 94, some examples of the baffle 94 are made of a relatively rigid material (e.g., sheet metal, stiff plastic, etc.) that is less flexible than the tubular wall 26. FIG. 20 shows the baffle 94*a* extending outward from the shaft in a radial direction (e.g., the radial direction 30 as depicted in FIG. 3) to provide a substantially fixed flow restriction with a circular cross-section perpendicular to the longitudinal direction. An airflow area 96 surrounds and extends radially from the perimeter of the baffle 94*a* to the tubular wall 26. Baffle 94*a* and airflow area 96 are substantially centered (e.g., located within 5 inches of the center) within the airduct 14 with respect to the radial direction 30. In some examples, the airflow area 96 is less than eighty percent of the cross-sectional area of the airduct 14. In the example shown in FIG. 20, the airflow area 96 is an annular space between an outer periphery 98 of the baffle 94*a* and an inner surface 100 of tubular wall 26.

FIG. 21 shows the baffle 94*b* extending inward from the tubular wall in the radial direction 30 to provide a substantially fixed flow restriction. An airflow area 102 with a circular cross-section perpendicular to the longitudinal direction 22 is surrounded and extends inward from the inner periphery 104 of the baffle 94*b* to the shaft 34. The baffle 94*b* and the airflow area 102 are substantially centered within the airduct 14 with respect to the radial direction 30. In some examples, the airflow area 102 is less than eighty percent of the cross-sectional area of the airduct 14. In the example shown in FIG. 21, the airflow area 102 is a circular space defined by an inner periphery 104 of the baffle 94*b*. To reduce the airflow disruption that might result from a solid (relatively impermeable) baffle, some examples of the baffle 94 are permeable—including perforations or constructed of permeable material (e.g., a perforated plate or woven screen), as shown in the illustrated examples of FIG. 20 and FIGS. 22-24.

Figure 22:
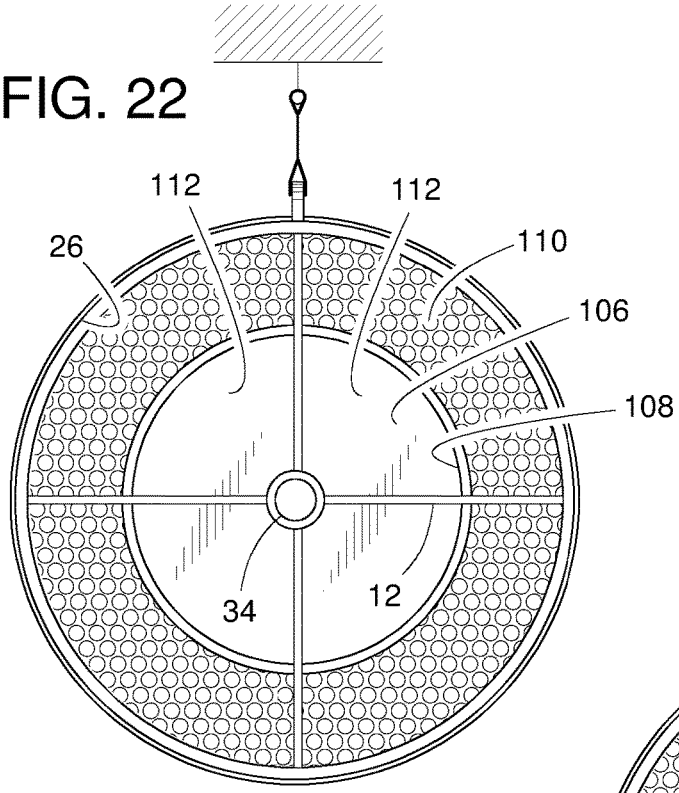
FIG. 22 is a cross-sectional view similar to FIG. 3 but showing the airduct system having an example baffle and valve constructed in accordance with teachings disclosed herein, showing the valve closed.
Figure 23:
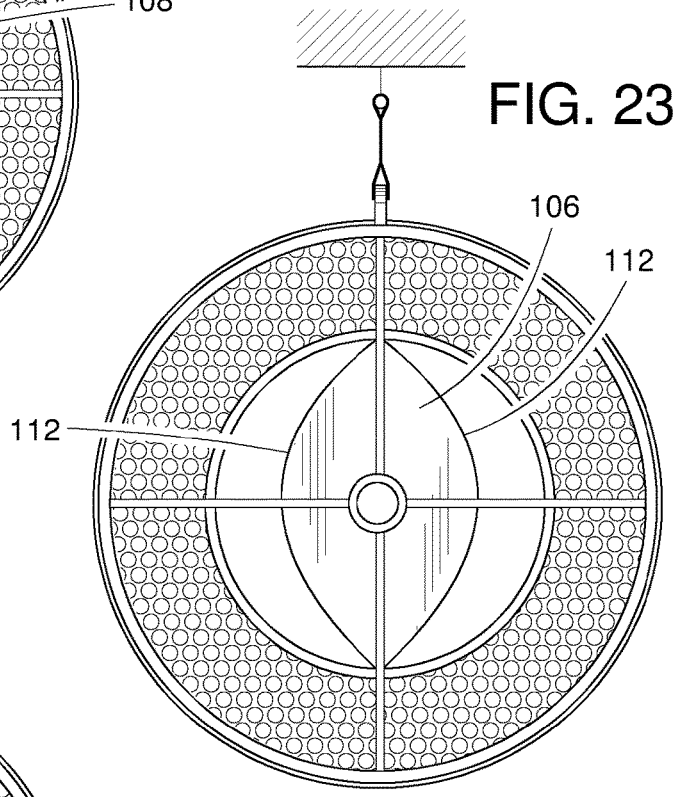
FIG. 23 is a cross-sectional view similar to FIG. 22 but showing the valve partially open.
Figure 24:
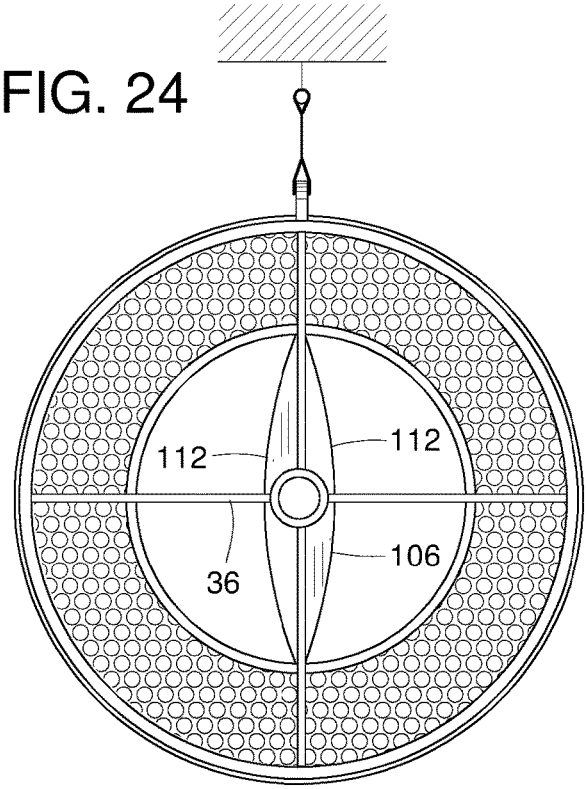
FIG. 24 is a cross-sectional view similar to FIGS. 22 and 23 but showing the valve open.
Figure 25:
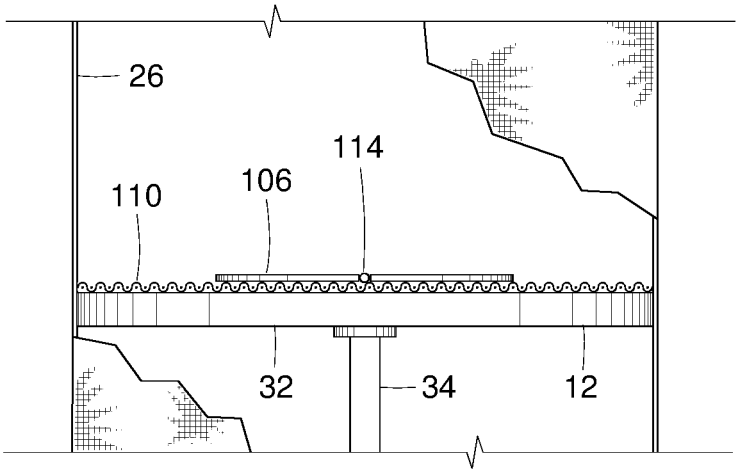
FIG. 25 is a cutaway top view of FIG. 22.
Figure 26:
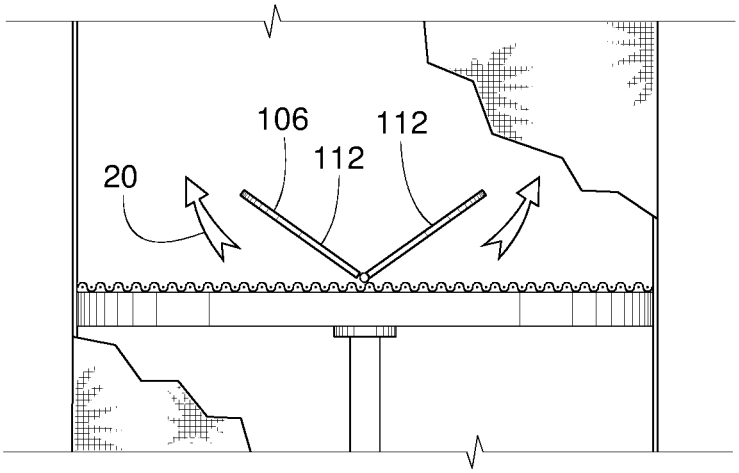
FIG. 26 is a cutaway top view of FIG. 23.
Figure 27:
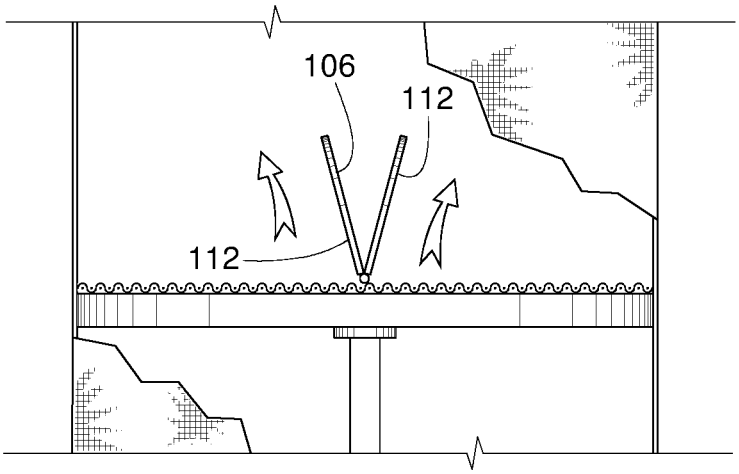
FIG. 27 is a cutaway top view of FIG. 24.
Figure 28:
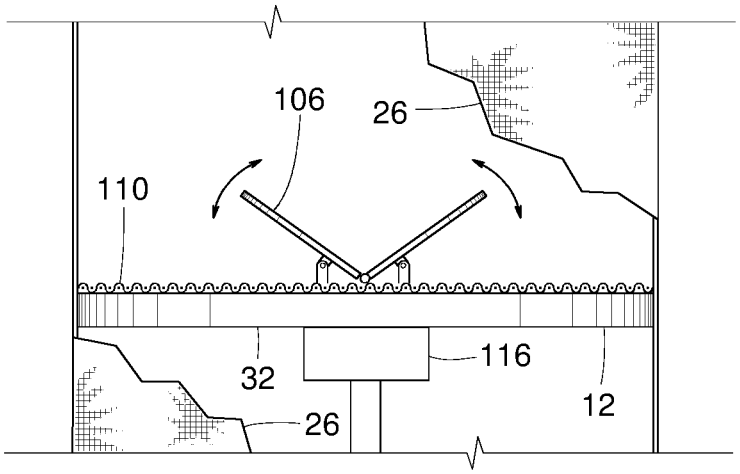
FIG. 28 is a cutaway top view similar to FIG. 26 but showing the valve connected to an example valve controller.

In the illustrated examples of FIGS. 22-27, a valve 106 is added to an example airduct system 10 providing an adjustable flow restriction. FIGS. 25, 26 and 27 are top views of FIGS. 22, 23 and 24 respectively. In the illustrated example, the valve 106 is centrally located within an inner periphery 108 of a fixed baffle 110. In this example, the valve 106 includes two flaps 112 made of a relatively stiff material (e.g., sheet metal or rigid plastic) that is more rigid than the pliable material of the tubular wall 26. The flaps 112 are connected by a hinge 114 that allows the valve 106 to move selectively to a closed position (e.g., as illustrated in the example of FIGS. 22 and 25), a partially open position (e.g., as illustrated in the example of FIGS. 23 and 26), and a fully open position (e.g., as illustrated in the example of FIGS. 24 and 27).

Any suitable mechanical means can be used for maintaining the valve 106 at a desired position. Alternatively, a controller 116, as shown in the illustrated example of FIG. 28, can be added to automatically adjust the position of the valve 106. Such a controller is sometimes known as a VAV or variable air volume controller. To securely support the valve 106 and/or the controller 116, some examples of the valve 106 and/or the controller 116 are attached to the frame 12 and operatively connected to the valve 106. In some examples, the controller 116 is attached to the frame 12 at a T-section 52 (e.g., as illustrated in the example of FIG. 5) or at a cross-section 54 (e.g., as illustrated in the example of FIG. 6), to control the airflow 20 from a supply and/or to a branch airduct. In some examples, the controller 116 is communicatively coupled (e.g., wireless and/or via wires) to a remote control device that may be used by a person to cause the controller 116 to adjust and/or actuate the valve 106. In some examples, such a remote control device directly adjusts and/or actuates the valve 106. Additionally or alternatively, in some examples, the controller 116 and/or other actuator for the valve 106 is communicatively coupled to a thermostat or other environmental sensor(s) (e.g., hygrometer) to automatically adjust and/or actuate the valve 106 without human involvement (e.g., once the parameters for the thermostat and/or other sensor(s) have been set).

Figure 29:
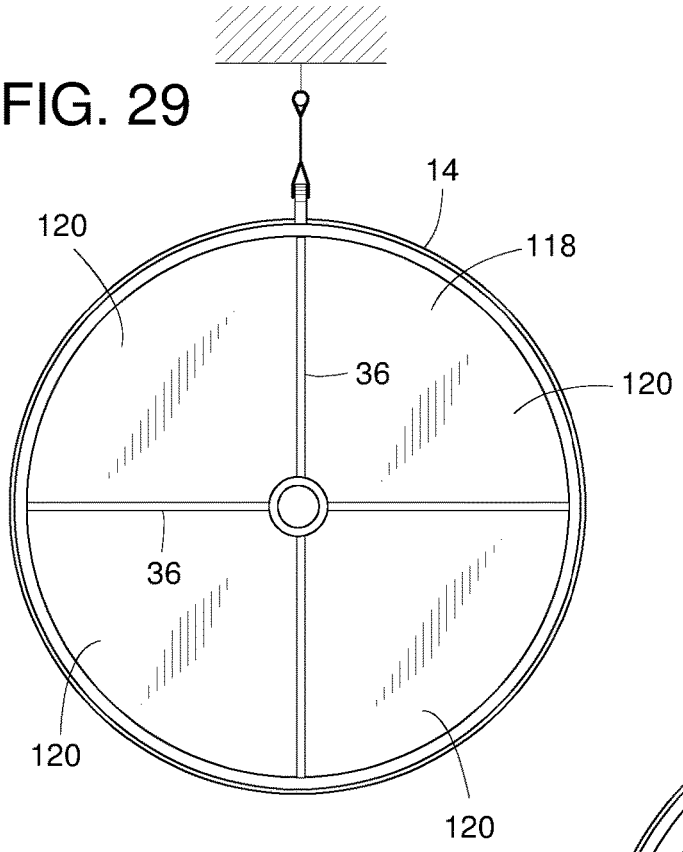
FIG. 29 is a cross-sectional view similar to FIG. 3 but showing the airduct system having another example valve constructed in accordance with teachings disclosed herein, showing the valve closed.
Figure 30:
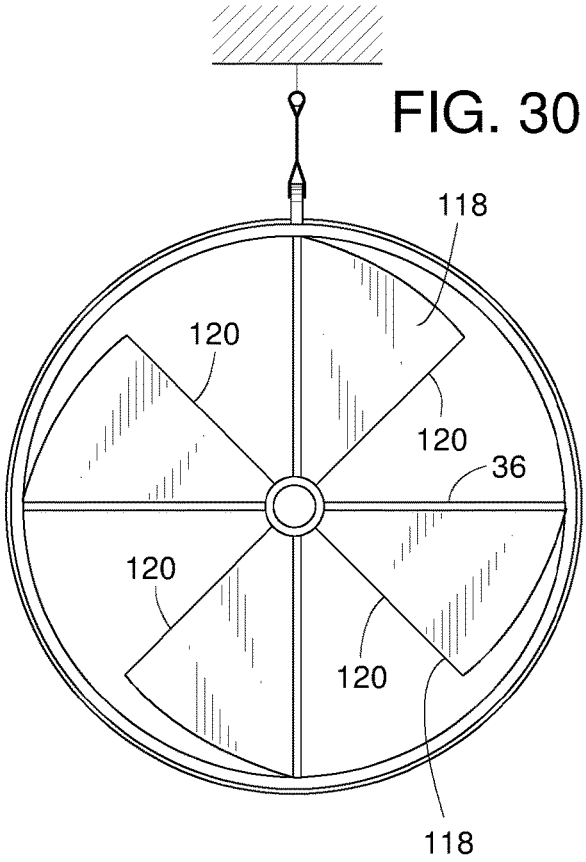
FIG. 30 is a cross-sectional view similar to FIG. 29 but showing the valve partially open.
Figure 31:
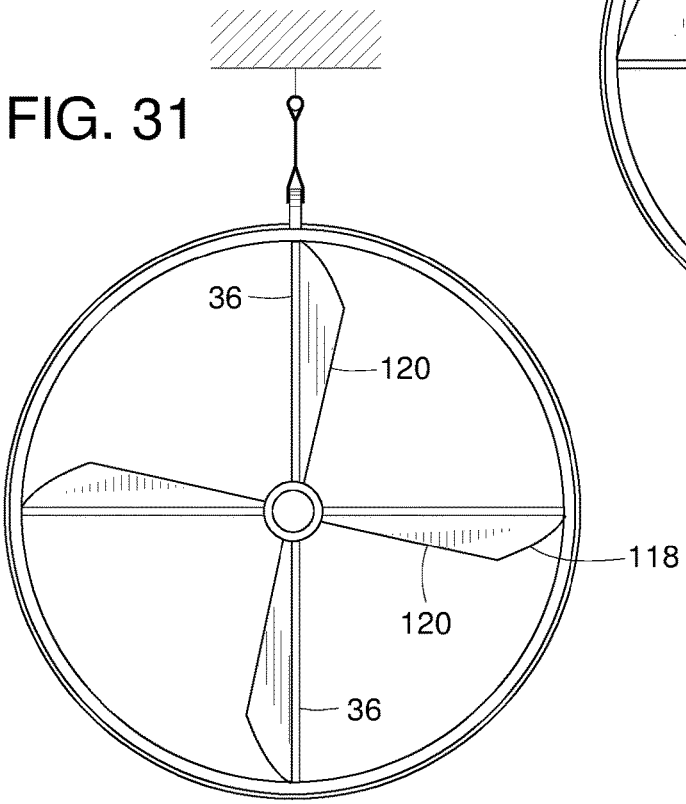
FIG. 31 is a cross-sectional view similar to FIGS. 29 and 30 but showing the valve open.

An example valve 118 shown in FIGS. 29-31, is similar to that of FIGS. 23-28; however, the baffle 110 of FIGS. 23-28 is omitted and the valve 118 extends fully across the cross-sectional area of the airduct 14. Further, as shown in the illustrated examples, the valve 118 includes four pivotal flaps 120 instead of just two. Each flap 120 is hinged to a spoke 36 so that the valve 118 can move selectively to a fully closed position (e.g., as illustrated in the example of FIG. 29), a partially open position (e.g., as illustrated in the example of FIG. 30), and a fully open position (e.g., as illustrated in the example of FIG. 31).

Figure 32:
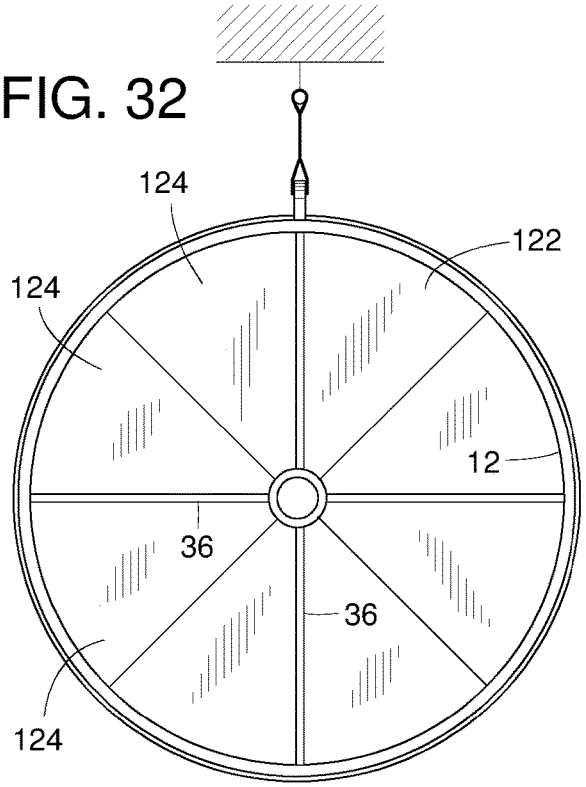
FIG. 32 is a cross-sectional view similar to FIG. 3 but showing the airduct system having another example valve constructed in accordance with teachings disclosed herein, showing the valve closed.
Figure 33:
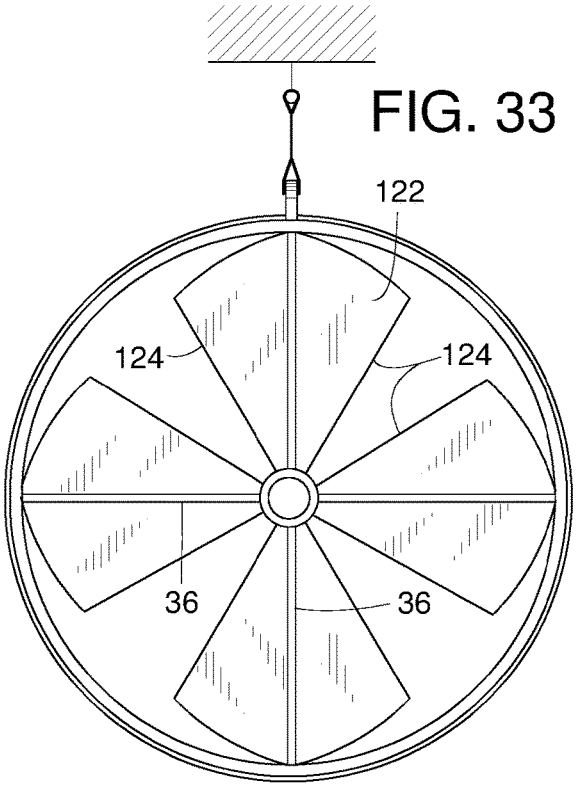
FIG. 33 is a cross-sectional view similar to FIG. 32 but showing the valve partially open.
Figure 34:
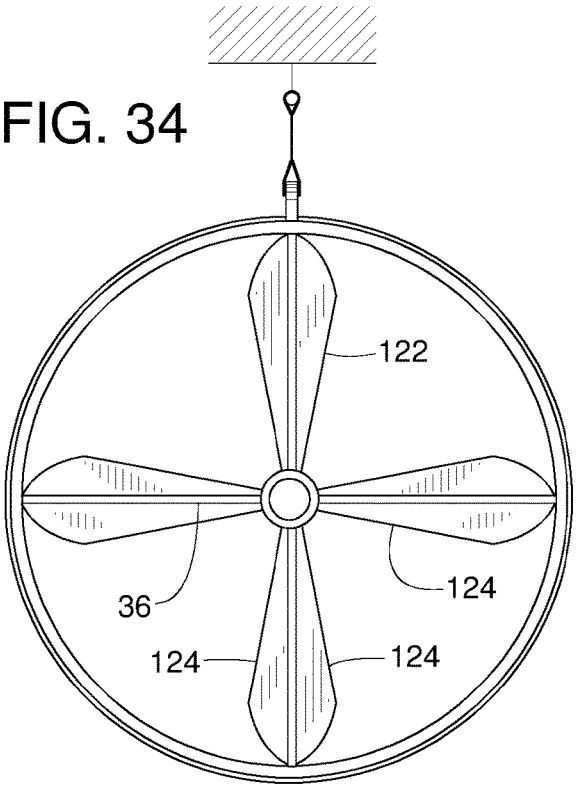
FIG. 34 is a cross-sectional view similar to FIGS. 32 and 33 but showing the valve open.

An example valve 122 shown in FIGS. 32-34, is similar to the valve 118 of FIGS. 29-31 but includes eight flaps 124 instead of four. In this example, each spoke 36 pivotally connects to two flaps 124. The valve 122 can move selectively to a fully closed position (e.g., as illustrated in the example of FIG. 32), a partially open position (e.g., as illustrated in the example of FIG. 33), and a fully open position (e.g., as illustrated in the example of FIG. 34). It should be noted that the frame 12 can have virtually any number of spokes 36 and virtually any number of valve flaps 124.

Figure 35:
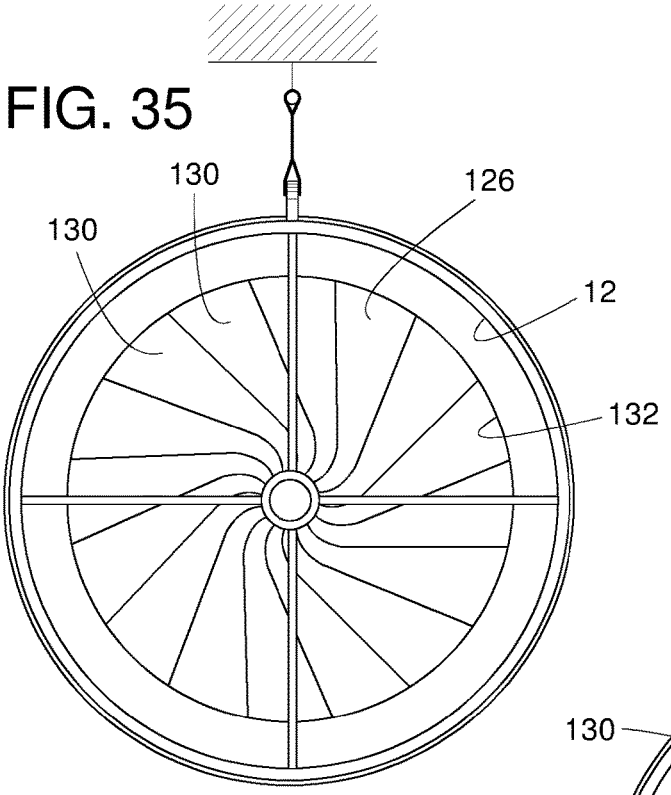
FIG. 35 is a cross-sectional view similar to FIG. 3 but showing the airduct system having another example valve constructed in accordance with teachings disclosed herein, showing the valve closed.
Figure 36:
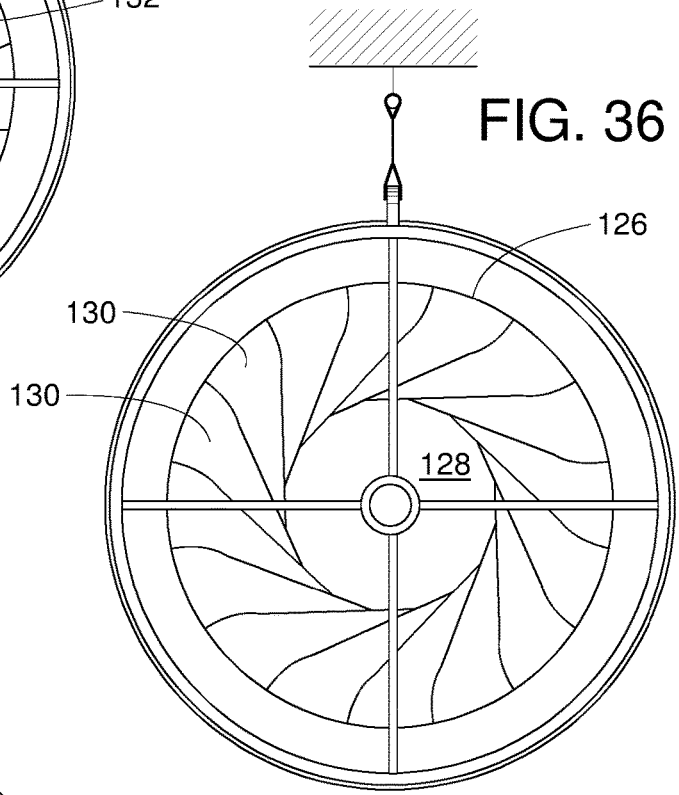
FIG. 36 is a cross-sectional view similar to FIG. 35 but showing the valve partially open.
Figure 37:
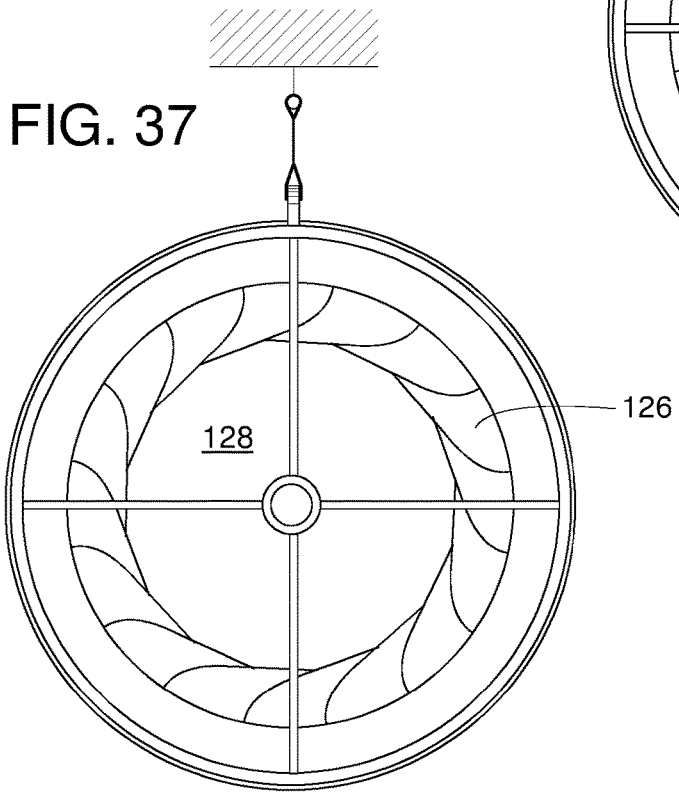
FIG. 37 is a cross-sectional view similar to FIGS. 35 and 36 but showing the valve open.
Figure 38:
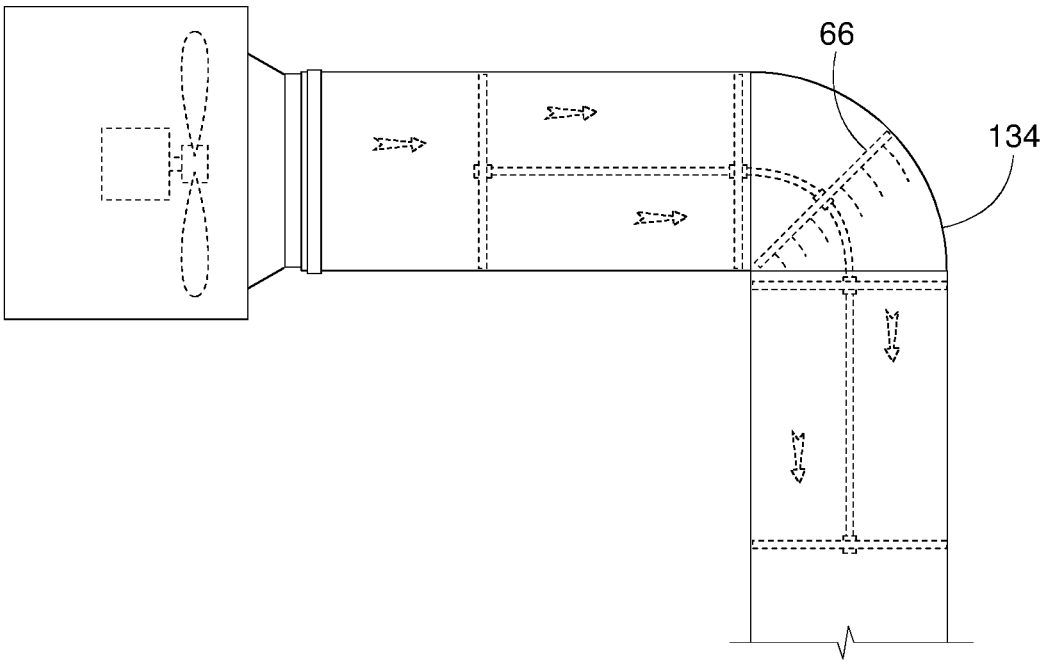
FIG. 38 is a top view similar to FIG. 9 but with the airduct system including another example flow turning device constructed in accordance with the teachings disclosed herein.
Figure 39:
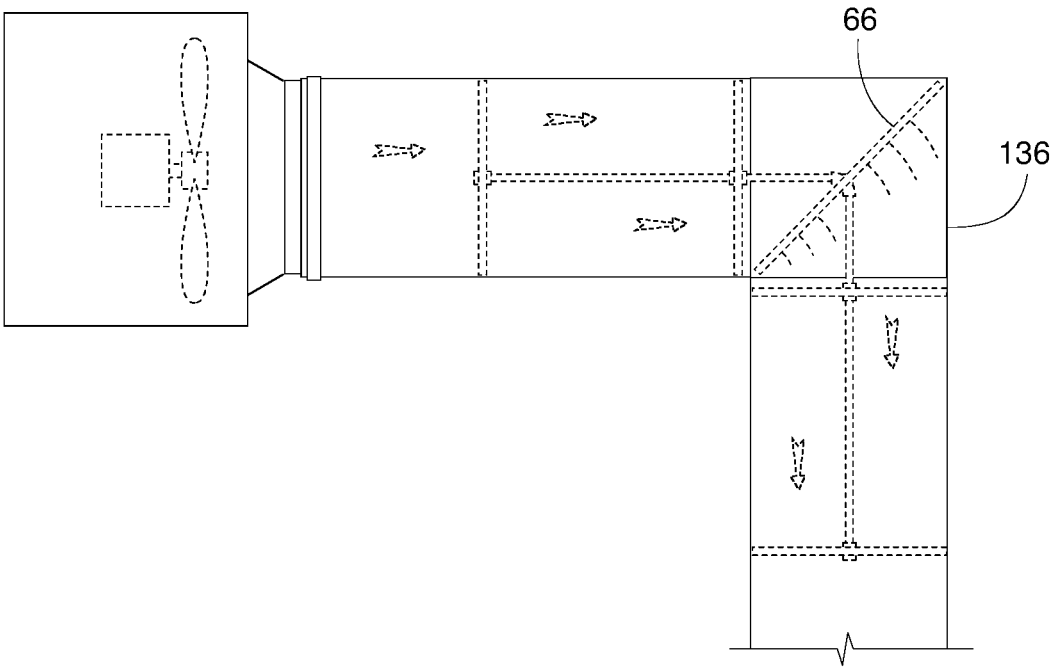
FIG. 39 is a top view similar to FIGS. 9 and 38 but with the airduct system including another example flow turning device constructed in accordance with the teachings disclosed herein.

In the illustrated example of FIGS. 35-37, a valve 126 includes an iris diaphragm attached to the frame 12 and defines a centrally located variable-sized opening 128 through which the air 20 passes. In this example, the valve 126 includes a plurality of relatively ridged leaves 130 that when pivoted by rotating an outer ring 132 moves the leaves to adjust the central opening 128. In some examples, the position and/or movement of the leaves 130 are controlled by a controller and/or other actuator similar to the controller 116 discussed above in connection with FIG. 26. In some examples, the controller and/or other actuator is controlled by a human via a remote control device and/or by a thermostat or other environmental sensor(s) (e.g., hygrometer). FIG. 35 shows the valve 126 fully closed, FIG. 36 shows the valve 126 partially open, and FIG. 37 shows the valve 126 fully open.

In some examples, other types of HVAC components may be installed with an airduct system such as, for example, an air filter. In some examples, the air filter is shaped to substantially fill a cross-section of an airduct so that air within the airduct passes through the filter. More particularly, in some such examples, an air filter is attached to one of the hoops 32 and fills the opening defined by the hoop 32. In other examples, a rectangular or square air filter is attached to one of the hoops 32. In some such examples, one or more baffles may be employed to fill the space between the rectangular filter and round hoop 32. Additionally or alternatively, in some examples, the HVAC components include one or more fans. In some examples, a fan is housed in a cylindrical housing substantially the same size as the hoops 32 so as to attach to and be supported by the hoops. In some examples, the fan (and/or the corresponding housing) may be significantly smaller than the diameter of the hoops 32. In some examples, the actuation, speed, and/or direction of rotation of such a fan is controlled by a controller and/or other actuator similar to the controller 116 discussed above in connection with FIG. 26. In some examples, the controller and/or other actuator is controlled by a human via a remote control device and/or by a thermostat or other environmental sensor(s) (e.g., hygrometer).

From the foregoing, it will be appreciated that example methods, apparatus, and articles of manufacture have been disclosed that enable a versatile airduct system including a multitude of air flow geometries using sections such as elbows and T-sections, as well as a variety of capabilities including turbulence reduction, humidification, heating, and air flow restriction. Examples disclosed herein include structure to support fabric ducts and enable the control (e.g., via valves), monitoring (e.g., via sensors) and conditioning (e.g., via resistance wires) of fluids conveyed therein without the condensation, drafts, and losses associated with metal ducts.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

Example 1 includes an airduct system comprising an airduct having an elongate tubular wall of a pliable material, a frame disposable inside the tubular wall of the airduct, the frame including a hoop the airduct to support the tubular wall in a radial direction, the hoop to define an opening to provide passage of a flow of air along a length of the airduct, and an HVAC component disposable within the tubular wall of the airduct, the HVAC component to be attached to and supported by the frame inside the airduct, the HVAC component to adjust a characteristic of the air.

Example 2 includes the airduct system of example 1, wherein the HVAC component includes a baffle to cover at least a portion of the opening of the hoop.

Example 3 includes the airduct system of example 2, wherein the baffle has a circular shape to be centered around a central axis of the tubular wall.

Example 4 includes the airduct system of example 3, wherein the baffle is to be positioned along a perimeter of the opening adjacent the hoop and spaced apart from the central axis.

Example 5 includes the airduct system of example 3, wherein the baffle is to be positioned adjacent the central axis and spaced apart from the hoop.

Example 6 includes the airduct system of example 2, wherein the portion of the opening covered by the baffle is a first portion, the HVAC component further including a valve to control the flow of the air through a second portion of the opening of the hoop, the second portion different than the first portion.

Example 7 includes the airduct system of example 1, wherein the HVAC component includes a valve to control the flow of air through the opening of the hoop.

Example 8 includes the airduct system of example 1, wherein the HVAC component includes an air straightener.

Example 9 includes an airduct system comprising an airduct having a tubular wall of a pliable material, the airduct being elongate in a longitudinal direction, a frame including a hoop disposable inside the airduct to support the tubular wall in a radial direction that is perpendicular to the longitudinal direction, the hoop being less flexible than the pliable material, the hoop to define a fully open airflow area extending substantially perpendicular to the longitudinal direction, and an HVAC component to be attached to the frame inside the airduct, the HVAC component to adjust a flow of air through the airduct.

Example 10 includes the airduct system of example 9, wherein the HVAC component includes a baffle, the baffle to extend in the radial direction to provide a flow restriction defining a partially open airflow area lying perpendicular to the longitudinal direction, the flow restriction to be substantially centered within the airduct with respect to the radial direction.

Example 11 includes the airduct system of example 10, wherein the partially open airflow area is defined by the hoop and an outer periphery of the baffle.

Example 12 includes the airduct system of example 10, wherein the partially open airflow area is at least partially defined by an inner periphery of the baffle.

Example 13 includes the airduct system of example 10, wherein the baffle is less flexible than the pliable material of the tubular wall.

Example 14 includes the airduct system of example 10, wherein the baffle is a perforated plate.

Example 15 includes the airduct system of example 10, wherein the baffle is a screen.

Example 16 includes the airduct system of example 10, further including a valve to provide an adjustable flow restriction, the valve to be attached to the frame adjacent to the baffle.

Example 17 includes the airduct system of example 10, wherein the partially open airflow area is less than eighty percent of the fully open airflow area.

Example 18 includes an airduct system comprising an airduct having a tubular wall of a pliable material, the airduct being elongate in a longitudinal direction, a hoop disposable inside the airduct to support the tubular wall in a radial direction that is perpendicular to the longitudinal direction, the hoop being less flexible than the pliable material, a frame including the hoop, a hanger to be connected to at least one of the frame or the tubular wall, the hanger to support the airduct in suspension, and an HVAC component to be attached to the frame inside the airduct, the HVAC component to adjust a flow of air through the airduct.

Example 19 includes the airduct system of example 18, wherein the HVAC component includes a valve to be attached to the frame inside the airduct, the valve to provide an adjustable flow restriction through which a current of air passes.

Example 20 includes the airduct system of example 19, wherein the valve includes a plurality of flaps each of which is pivotally adjustable relative to the frame.

Example 21 includes the airduct system of example 19, wherein the valve includes an iris diaphragm defining a variable opening that, with respect to the radial direction, is centrally located within the airduct.

Example 22 includes the airduct system of example 19, further including an electric controller to be attached to the frame and being operatively connected to the valve to adjust the adjustable flow restriction.

Example 23 includes the airduct system of example 22, wherein the airduct includes a T-section defining a plurality of airflow branches, and the controller is at the T-section.

Example 24 includes the airduct system of example 22, wherein the airduct includes a manifold defining a plurality of airflow branches, and the controller is at the manifold.

Example 25 includes an airduct system comprising an airduct having a tubular wall of a pliable material, the airduct being elongate in a longitudinal direction, a hoop disposable inside the airduct to support the tubular wall in a radial direction that is perpendicular to the longitudinal direction, the hoop being less flexible than the pliable material, and an airflow guide vane to be attached to and supported by the hoop, the airflow guide vane having a leading edge and a trailing edge, the leading edge to be upstream of the trailing edge with respect to a current of air to flow through the airduct, the airflow guide vane having a guiding surface extending from the leading edge to the trailing edge, the guiding surface to extend substantially parallel to the longitudinal direction to direct the current of air in the longitudinal direction.

Example 26 includes the airduct system of example 25, wherein the airflow guide vane is less flexible than the pliable material of the tubular wall.

Example 27 includes the airduct system of example 25, further including a plurality of airflow guide vanes, wherein the airflow guide vanes are substantially parallel to each other.

Example 28 includes the airduct system of example 25, wherein the guiding surface is substantially planar.

Example 29 includes the airduct system of example 25, wherein the guiding surface is curved.

Example 30 includes the airduct system of example 25, wherein the airduct includes an elbow section, the airflow guide vane to be disposed within the elbow section, and the guiding surface is curved.

Example 31 includes the airduct system of example 25, wherein the hoop is a first hoop, the airduct system further including a frame that includes the first hoop, a second hoop disposable inside the airduct, and a shaft, the second hoop to be spaced apart from the first hoop, the shaft to couple the first hoop and the second hoop.

Example 32 includes the airduct system of example 31, further including a hanger to be connected to at least one of the frame or the tubular wall to support the airduct in suspension.

Example 33 includes the airduct system of example 31, wherein the airflow guide vane extends a distance between the first and second hoops.

Example 34 includes an airduct system comprising an airduct having a tubular wall of a pliable material, the airduct being elongate in a longitudinal direction, a frame including a hoop disposable inside the airduct to support the tubular wall in a radial direction that is perpendicular to the longitudinal direction, the hoop being less flexible than the pliable material, and a gas sensor to be attached to the frame to be in fluid communication with a current of air within the airduct, the gas sensor to provide a feedback signal that varies in response to a changing condition of the current of air.

Example 35 includes the airduct system of example 34, wherein the hoop is a first hoop, the frame further including a second hoop, a shaft coupling the first hoop to the second hoop, and a spoke extending in the radial direction between the shaft and the first hoop, wherein the gas sensor is to be attached to the spoke.

Example 36 includes the airduct system of example 34, wherein the feedback signal is pneumatic and the changing condition is a change in static pressure of the current of air.

Example 37 includes the airduct system of example 34, wherein the feedback signal is pneumatic and the changing condition is a change in stagnation pressure of the current of air.

Example 38 includes the airduct system of example 34, wherein the feedback signal is electric and the changing condition is a change in temperature of the current of air.

Example 39 includes the airduct system of example 34, wherein the feedback signal is electric and the changing condition is a change in humidity of the current of air.

Example 40 includes the airduct system of example 34, wherein the feedback signal is electric and the changing condition is a change in a concentration of carbon dioxide of the current of air.

Example 41 includes the airduct system of example 34, wherein the feedback signal is electric and the changing condition is a change in a concentration of smoke within the current of air.

Example 42 includes an airduct system comprising an airduct having a tubular wall of a pliable material, the airduct being elongate in a longitudinal direction, a frame including a hoop disposable inside the airduct to support the tubular wall in a radial direction that is perpendicular to the longitudinal direction, the hoop being less flexible than the pliable material, and a temperature altering device attachable to the frame to be in heat transfer relationship with a current of air inside the airduct, the temperature altering device to cause the current of air to change in temperature as the current of air flows proximate the temperature altering device.

Example 43 includes the airduct system of example 42, wherein the temperature altering device is a tube conveying a fluid.

Example 44 includes the airduct system of example 43, wherein the hoop is a first hoop, the frame further including a second hoop and a shaft to couple the first hoop and the second hoop, the shaft being hollow to serve as the tube.

Example 45 includes the airduct system of example 42, wherein the temperature altering device includes an electric resistance wire.

Example 46 includes the airduct system of example 42, wherein the hoop is a first hoop, the frame further including a second hoop and a shaft to couple the first hoop and the second hoop, wherein the shaft is hollow to serve as a conduit, and the temperature altering device includes an electric resistance wire inside the conduit.

Example 47 includes the airduct system of example 42, wherein the temperature altering device is a heat exchanger including a plurality of fins.

Example 48 includes the airduct system of example 42, wherein the temperature altering device includes a nozzle to discharge water into the current of air to change at least one of a temperature or a humidity of the current of air.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

What is claimed is:

1. An airduct system comprising:

an airduct having an elongate tubular wall of a pliable material;

a frame disposable inside the tubular wall of the airduct, the frame including a hoop to support the tubular wall in a radial direction, the hoop to define an opening to provide passage of a flow of air along a length of the airduct;

a plurality of guide vanes including a first guide vane to be attached to and supported by the hoop, the first guide vane having a guiding surface that is to be maintained at a distance from a central axis of the tubular wall along a length of the guiding surface to direct a current of air along the length of the airduct, the plurality of guide vanes to be substantially parallel to each other; and an HVAC component disposable within the tubular wall of the airduct, the HVAC component to be attached to and supported by the frame inside the airduct, the HVAC component to adjust a characteristic of the air.

2. The airduct system of claim 1, wherein the hoop is a first hoop and the opening is a first opening, the airduct system further including a baffle disposable within the tubular wall of the airduct to cover at least a portion of a second opening of a second hoop of the frame.

3. The airduct system of claim 2, wherein the baffle has a circular shape to be centered around the central axis of the tubular wall.

4. The airduct system of claim 3, wherein the baffle is to be positioned along a perimeter of the second opening adjacent the second hoop and spaced apart from the central axis.

5. The airduct system of claim 3, wherein the baffle is to be positioned adjacent the central axis and spaced apart from the second hoop.

6. The airduct system of claim 2, wherein the portion of the second opening covered by the baffle is a first portion, the airduct system further including a valve to control the flow of the air through a second portion of the second opening of the second hoop, the second portion different than the first portion.

7. The airduct system of claim 1, wherein the hoop is a first hoop and the opening is a first opening, the airduct system further including a valve to control the flow of air through a second opening of a second hoop of the frame.

8. The airduct system of claim 1, wherein the plurality of guide vanes correspond to an air straightener.

9. An airduct system comprising:

an airduct having a tubular wall of a pliable material, the airduct being elongate in a longitudinal direction, the airduct including a manifold defining a plurality of airflow branches;

a frame including a hoop disposable inside the airduct to support the tubular wall in a radial direction that is perpendicular to the longitudinal direction, the hoop being less flexible than the pliable material, the hoop to define a fully open airflow area extending substantially perpendicular to the longitudinal direction; and a valve to be attached to the frame inside the airduct, the valve to provide an adjustable flow restriction to adjust a flow of air through the airduct; and an electric controller to be attached to the frame at the manifold and operatively connected to the valve to adjust the adjustable flow restriction.

10. The airduct system of claim 9, further including a baffle, the baffle to extend in the radial direction to provide a flow restriction defining a partially open airflow area lying perpendicular to the longitudinal direction, the flow restriction to be substantially centered within the airduct with respect to the radial direction.

11. The airduct system of claim 10, wherein the partially open airflow area is defined by the hoop and an outer periphery of the baffle.

12. The airduct system of claim 10, wherein the partially open airflow area is at least partially defined by an inner periphery of the baffle.

13. The airduct system of claim 10, wherein the baffle is less flexible than the pliable material of the tubular wall.

14. The airduct system of claim 10, wherein the baffle is a perforated plate.

15. The airduct system of claim 10, wherein the baffle is a screen.

16. The airduct system of claim 10, wherein the valve is to be attached to the frame adjacent to the baffle.

17. The airduct system of claim 10, wherein the partially open airflow area is less than eighty percent of the fully open airflow area.

18. An airduct system comprising:

an airduct having a tubular wall of a pliable material, the airduct being elongate in a longitudinal direction, the airduct including a T-section defining a plurality of airflow branches;

a hoop disposable inside the airduct to support the tubular wall in a radial direction that is perpendicular to the longitudinal direction, the hoop being less flexible than the pliable material;

a frame including the hoop;

a hanger to be connected to at least one of the frame or the tubular wall, the hanger to support the airduct in suspension;

a valve to be attached to the frame inside the airduct, the valve to adjust a flow of air through the airduct by providing an adjustable flow restriction through which a current of air passes; and an electric controller to be attached to the frame at the T-section and operatively connected to the valve to adjust the adjustable flow restriction.

19. The airduct system of claim 18, wherein the valve includes a plurality of flaps each of which is pivotally adjustable relative to the frame.

20. The airduct system of claim 18, wherein the valve includes an iris diaphragm defining a variable opening that, with respect to the radial direction, is centrally located within the airduct.

21. An airduct system comprising:

an airduct having a tubular wall of a pliable material, the airduct being elongate in a longitudinal direction, the airduct including a manifold defining a plurality of airflow branches;

a hoop disposable inside the airduct to support the tubular wall in a radial direction that is perpendicular to the longitudinal direction, the hoop being less flexible than the pliable material;

a frame including the hoop;

a hanger to be connected to at least one of the frame or the tubular wall, the hanger to support the airduct in suspension;

a valve to be attached to the frame inside the airduct, the valve to provide an adjustable flow restriction through which a current of air passes to adjust a flow of air through the airduct; and an electric controller to be attached to the frame at the manifold and operatively connected to the valve to adjust the adjustable flow restriction.

22. An airduct system comprising:

an airduct having a tubular wall of a pliable material, the airduct being elongate along a central axis of the airduct;

a hoop disposable inside the airduct to support the tubular wall in a radial direction that is perpendicular to the central axis, the hoop being less flexible than the pliable material; and a plurality of airflow guide vanes including a first airflow guide vane to be attached to and supported by the hoop, the first airflow guide vane having a leading edge and a trailing edge, the leading edge to be upstream of the trailing edge with respect to a current of air to flow through the airduct, the first airflow guide vane having a guiding surface extending from the leading edge to the trailing edge, the guiding surface to extend in a direction that follows the central axis of the airduct to direct the current of air along the airduct, the plurality of airflow guide vanes to be substantially parallel to each other.

23. The airduct system of claim 22, wherein the first airflow guide vane is less flexible than the pliable material of the tubular wall.

24. The airduct system of claim 22, wherein the guiding surface is substantially planar.

25. The airduct system of claim 22, wherein the guiding surface is curved.

26. The airduct system of claim 22, wherein the airduct includes an elbow section, the first airflow guide vane to be disposed within the elbow section, and the guiding surface is curved.

27. The airduct system of claim 22, wherein the hoop is a first hoop, the airduct system further including a frame that includes the first hoop, a second hoop disposable inside the airduct, and a shaft, the second hoop to be spaced apart from the first hoop, the shaft to couple the first hoop and the second hoop.

28. The airduct system of claim 27, further including a hanger to be connected to at least one of the frame or the tubular wall to support the airduct in suspension.

29. The airduct system of claim 27, wherein the first airflow guide vane extends a distance between the first and second hoops.

* * * * *